US011322133B2

(12) United States Patent
Shekhar et al.

(10) Patent No.: US 11,322,133 B2
(45) Date of Patent: May 3, 2022

(54) EXPRESSIVE TEXT-TO-SPEECH UTILIZING CONTEXTUAL WORD-LEVEL STYLE TOKENS

(71) Applicant: Adobe Inc., San Jose, CA (US)

(72) Inventors: Sumit Shekhar, Bengaluru (IN); Gautam Choudhary, Sri Ganganagar (IN); Abhilasha Sancheti, College Park, MD (US); Shubhanshu Agarwal, Agra (IN); E Santhosh Kumar, Chennai (IN); Rahul Saxena, Kanpur (IN)

(73) Assignee: Adobe Inc., San Jose, CA (US)

( * ) Notice: Subject to any disclaimer, the term of this patent is extended or adjusted under 35 U.S.C. 154(b) by 3 days.

(21) Appl. No.: 16/934,836

(22) Filed: Jul. 21, 2020

(65) Prior Publication Data

US 2022/0028367 A1 Jan. 27, 2022

(51) Int. Cl.
*G10L 25/30* (2013.01)
*G10L 13/047* (2013.01)

(52) U.S. Cl.
CPC ..... *G10L 13/047* (2013.01); *G10L 25/30* (2013.01)

(58) Field of Classification Search
CPC ..... G10L 13/047; G10L 25/30
USPC ..... 704/260
See application file for complete search history.

(56) References Cited

U.S. PATENT DOCUMENTS 10,943,604 B1 * 3/2021 Bone ..... G10L 25/63
11,056,096 B2 * 7/2021 Chae ..... G10L 13/033
2018/0308487 A1 * 10/2018 Goel ..... G10L 15/26
2020/0320398 A1 * 10/2020 Lyske ..... G06N 3/08
2020/0372897 A1 * 11/2020 Battenberg ..... G06N 3/0481
2021/0035551 A1 * 2/2021 Stanton ..... G10L 13/10

FOREIGN PATENT DOCUMENTS

CN 103578462 A * 2/2014 ..... G10L 13/02

OTHER PUBLICATIONS

I. Jauk, A. Bonafonte and S. Pascual, "Acoustic feature prediction from semantic features for expressive speech using deep neural networks," 2016 24th European Signal Processing Conference (EUSIPCO), 2016, pp. 2320-2324, doi: 10.1109/EUSIPCO .2016. 7760663. (Year: 2016).*

(Continued)

*Primary Examiner* — Bharatkumar S Shah
(74) *Attorney, Agent, or Firm* — Keller Preece PLLC

(57) ABSTRACT

The present disclosure relates to systems, methods, and non-transitory computer-readable media that generate expressive audio for input texts based on a word-level analysis of the input text. For example, the disclosed systems can utilize a multi-channel neural network to generate a character-level feature vector and a word-level feature vector based on a plurality of characters of an input text and a plurality of words of the input text, respectively. In some embodiments, the disclosed systems utilize the neural network to generate the word-level feature vector based on contextual word-level style tokens that correspond to style features associated with the input text. Based on the character-level and word-level feature vectors, the disclosed systems can generate a context-based speech map. The disclosed systems can utilize the context-based speech map to generate expressive audio for the input text.

20 Claims, 12 Drawing Sheets

(56) References Cited

OTHER PUBLICATIONS

Wang, Peilu, et al. "Word embedding for recurrent neural network based TTSsynthesis." 2015 IEEE International Conference on Acoustics, Speech and Signal Processing (ICASSP). IEEE, 2015.
Rendel, Asaf, et al. "Using continuous lexical embeddings to improve symbolic-prosody prediction in a text-to-speech front-end." 2016 IEEE International Conference on Acoustics, Speech and Signal Processing (ICASSP). IEEE, 2016.
Stanton, Daisy, Yuxuan Wang, and R. J. Skerry-Ryan. "Predicting expressive speaking style from text in end-to-end speech synthesis." 2018 IEEE Spoken Language Technology Workshop (SLT). IEEE, 2018.
Chung, Yu-An, et al. "Semi-supervised training for improving data efficiency in end-to-end speech synthesis." ICASSP 2019-2019 IEEE International Conference on Acoustics, Speech and Signal Processing (ICASSP). IEEE, 2019.
Shen, Jonathan, et al. "Natural tts synthesis by conditioning wavenet on mel spectrogram predictions." 2018 IEEE International Conference on Acoustics, Speech and Signal Processing (ICASSP). IEEE, 2018.
Wang, Yuxuan, et al. "Style tokens: Unsupervised style modeling, control and transfer in end-to-end speech synthesis." arXiv preprint arXiv:1803.09017 (2018).
Prenger, Ryan, Rafael Valle, and Bryan Catanzaro. "Waveglow: A flow-based generative network for speech synthesis." ICASSP 2019-2019 IEEE International Conference on Acoustics, Speech and Signal Processing (ICASSP). IEEE, 2019.
Devlin, Jacob et al. "Bert: Pre-training of deep bidirectional transformers for language understanding." arXiv preprint arXiv:1810.04805 (2018).
Bahdanau, Dzmitry, Kyunghyun Cho, and Yoshua Bengio. "Neural machine translation by jointly learning to align and translate." arXiv preprint arXiv:1409.0473 (2014).
The LJ Speech Dataset, Date downloaded Aug. 5, 2020; https://keithito.com/LJ-Speech-Dataset/.
Open Speech and Language Resources, Date downloaded Aug. 5, 2020; http://www.openslr.org/60/.
The IBM Expressive Text-to-Speech Synthesis System for American English; Date downloaded Aug. 5, 2020; (https://ieeexplore.ieee.org/stamp/stamp.jsp?tp=&arnumber=1643639).
Vaswani, Ashish, et al. "Attention is all you need." Advances in neural information processing systems. 2017.
Google Speech-to-Text API, Date downloaded Aug. 5, 2020; https://cloud.google.com/speech-to-text/.
ASR Evaluation—Github, Date downloaded Aug. 5, 2020; https://github.com/belambert/asr-evaluation.
Free E-Books—Project Glutenberg, Date downloaded Aug. 5, 2020; https://www.gutenberg.org/.

* cited by examiner

| Method | Word Error Rate |
|---|---|
| Proposed Model | **0.099** |
| Tacotron 2 | 0.104 |

*Fig. 7*

| Metric | Proposed Model | Neutral | Tacotron2 |
|---|---|---|---|
| Human-like Voice | **21** | 22 | 7 |
| Audio Quality | **13** | 30 | 7 |
| Correct Intonation | **33** | 7 | 10 |
| Pronunciation | **15** | 27 | 8 |
| Emotional Context | **27** | 14 | 9 |

*Fig. 8*

EXPRESSIVE TEXT-TO-SPEECH UTILIZING CONTEXTUAL WORD-LEVEL STYLE TOKENS

BACKGROUND

Recent years have seen significant advancement in hardware and software platforms for generating synthesized speech from input text. For example, many systems operate to generate, based on the natural language of digital text, a synthesized speech output that conveys a human-like naturalness and expressiveness to effectively communicate the contents of the digital text. Such systems may utilize concatenative models that model human speech using transition matrices, end-to-end models that provide a deeper learning approach, or various other models for generating synthesized speech output from digital text.

Despite these advances, however, conventional text-to-speech systems often suffer from several technological shortcomings that result in inflexible and inaccurate operation. For example, conventional text-to-speech systems are often inflexible in that they rigidly rely solely on character-based encodings of digital text to generate the corresponding synthesized speech output. While such character-level information is indeed important in some respects, such as for learning the pronunciation of a word, sole reliance on character-level information fails to account for other characteristics of the digital text. For instance, such systems often fail to flexibly account for the context (e.g., the context of a word within a sentence) and associated style of the digital text when determining how to generate the speech output. As a particular example, where two different sentences include the same term, conventional systems often rigidly communicate those terms in the same way within their corresponding synthesized speech output, even where the contexts of the two sentences differ significantly.

In addition to flexibility concerns, conventional text-to-speech systems can also operate inaccurately. In particular, by relying solely on character-based encodings of digital text, conventional text-to-speech systems often fail to generate synthesized speech that accurately communicates the expressiveness (e.g., modulation, pitch, emotion, etc.) and intent of the digital text. For example, such systems may determine to generate a vocalization of a particular word or sentence that fails to accurately convey the expressiveness and intent indicated by the context surrounding that word or sentence.

The foregoing drawbacks, along with additional technical problems and issues, exist with regard to conventional text-to-speech systems.

SUMMARY

One or more embodiments described herein provide benefits and/or solve one or more of the foregoing or other problems in the art with systems, methods, and non-transitory computer-readable media that accurately generate expressive audio for an input text based on the context of the input text. For example, in one or more embodiments, the disclosed systems utilize a deep learning model to encode character-level information corresponding to a sequence of characters of an input text to learn pronunciations. The disclosed systems further utilize a contextual word-level style predictor of the deep learning model to separately encode contextual information of the input text. Specifically, the disclosed systems can use contextual word embeddings to learn style tokens that correspond to various style features (e.g., emotion, pitch, modulation, etc.). In some embodiments, the disclosed systems further utilize the deep learning model to encode a speaker identity. Based on the various encodings, the disclosed systems can generate an expressive audio for the input text. In this manner, the disclosed systems can flexibly utilize context-based word-level encodings to capture the style of an input text and generate audio (e.g., synthesized speech) that accurately conveys the expressiveness of the input text.

Additional features and advantages of one or more embodiments of the present disclosure are outlined in the following description.

BRIEF DESCRIPTION OF THE DRAWINGS

This disclosure will describe one or more embodiments of the invention with additional specificity and detail by referencing the accompanying figures. The following paragraphs briefly describe those figures, in which:

FIG. 7 illustrates a table reflecting experimental results regarding the effectiveness of the expressive audio generation system in accordance with one or more embodiments;

FIG. 8 illustrates another table reflecting experimental results regarding the effectiveness of the expressive audio generation system in accordance with one or more embodiments;

DETAILED DESCRIPTION

Figure 1:
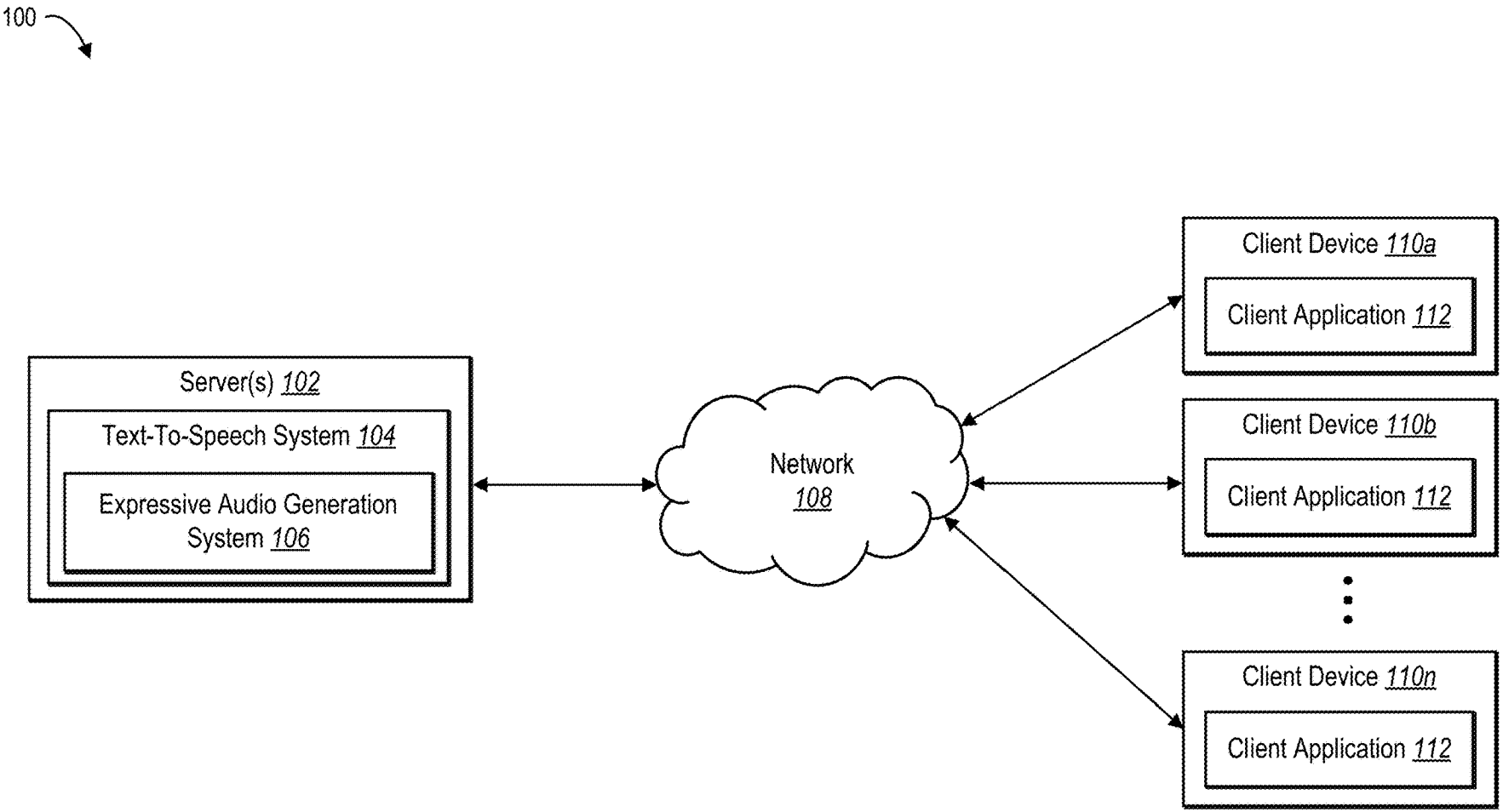
FIG. 1 illustrates an example environment in which an expressive audio generation system can operate in accordance with one or more embodiments.

One or more embodiments described herein include an expressive audio generation system that generates audio that accurately captures the expressiveness of an input text based on style features extracted by a deep learning neural network architecture. In particular, the expressive audio generation system can utilize a neural network having a multi-channel, deep learning architecture to encode the word-level information of an input text separately from the character-level information. In particular, in one or more embodiments, the neural network encodes the word-level information based on a context of the input text and further extracts style tokens based on the encoded context. The style tokens can correspond to various style features—such as pitch, emotion, and/or modulation—to be conveyed by the audio generated for the input text. In some embodiments, the expressive audio generation system further utilizes the neural network to encode a speaker identity for the input text. Based on the encoded information, the expressive audio generation system can generate expressive audio that conveys an expressiveness indicated by the context of the input text.

To provide an illustration, in one or more embodiments, the expressive audio generation system identifies (e.g., receives or otherwise accesses) an input text comprising a set of words. The expressive audio generation system determines, utilizing a character-level channel of an expressive speech neural network, a character-level feature vector based on a plurality of characters associated with the plurality of words. Further, the expressive audio generation system determines, utilizing a word-level channel of the expressive speech neural network, a word-level feature vector based on contextual word embeddings corresponding to the plurality of words. Utilizing a decoder of the expressive speech neural network, the expressive audio generation system generates a context-based speech map (e.g., a Mel spectrogram) based on the character-level feature vector and the word-level feature vector. The expressive audio generation system utilizes the context-based speech map to generate expressive audio for the input text.

As mentioned above, in one or more embodiments, the expressive audio generation system utilizes a neural network having a multi-channel architecture—such as an expressive speech neural network—to analyze an input text. In particular, the expressive audio generation system can utilize the channels of the expressive speech neural network to analyze the character-level information of an input text separately from the word-level information of an input text. For example, the expressive audio generation system can utilize a character-level channel of the expressive speech neural network to generate a character-level feature vector based on a plurality of characters of the input text.

Further, the expressive audio generation system can utilize a word-level channel of the expressive speech neural network to generate a word-level feature vector based on a plurality of words of the input text. In particular, the expressive audio generation system can utilize the word-level channel to capture the context of the plurality of words of the input text within the word-level feature vector based on contextual word embeddings corresponding to the input text.

To illustrate, in one or more embodiments, the expressive audio generation system utilizes the word-level channel to analyze contextual word embeddings (e.g., pre-trained contextual word embeddings) that capture the context of the corresponding words within the input text. In some embodiments, the contextual word embeddings capture the context of the corresponding words within a larger block of text (e.g., one or more paragraphs). From the contextual word embeddings, the word-level channel can generate contextual word-level style tokens that correspond to one or more style features associated with the input text based on the captured context. Accordingly, the word-level channel can generate the word-level feature vector based on the contextual word-level style tokens.

In one or more embodiments, the expressive speech neural network also includes a speaker identification channel. Further, the expressive audio generation system can receive user input that corresponds to a speaker identity for the input text. Accordingly, the expressive audio generation system can utilize the speaker identification channel of the expressive speech neural network to generate a speaker identity feature vector based on the speaker identity. By utilizing a speaker identity feature vector, the expressive audio generation system can tailor resulting audio to specific characteristics (e.g., gender, age, etc.) of a particular speaker.

As further mentioned above, in one or more embodiments, the expressive audio generation system generates a context-based speech map (e.g., a Mel spectrogram) based on the character-level feature vector and the word-level feature vector. In particular, the expressive audio generation system can utilize a decoder of the expressive speech neural network to generate the context-based speech map. In some embodiments, the expressive audio generation system utilizes the decoder to generate the context-based speech map further based on a speaker identity feature vector corresponding to a speaker identity.

Additionally, as mentioned above, in one or more embodiments, the expressive audio generation system generates expressive audio for the input text utilizing the context-based speech map. Thus, the expressive audio can incorporate one or more style features associated with the input text based on the context captured by the expressive speech neural network.

The expressive audio generation system provides several advantages over conventional systems. For example, the expressive audio generation system can operate more flexibly than conventional systems. Indeed, by analyzing word-level information of an input text—particularly, by analyzing the contextual word embeddings corresponding to the words of the input text—the expressive audio generation system flexibly captures the context (e.g., word-level context, sentence-level context, etc.) of the input text. Accordingly, the expressive audio generation system can flexibly generate synthesized speech—the corresponding expressive audio—that incorporates style features corresponding to the captured context. To provide one example, by capturing word-level and/or sentence-level contexts, the expressive audio generation system can flexibly customize the communication of a term or phrase within different expressive audio outputs to match the contexts or their corresponding input texts.

Further, the expressive audio generation system can improve accuracy. In particular, by analyzing the word-level information in addition to the character-level information of an input text, the expressive audio generation system can generate expressive audio that more accurately conveys the expressiveness and intent of the input text. Indeed, by capturing the context of an input text, the expressive audio generation system can accurately convey the expressiveness that is indicated by that context.

As illustrated by the foregoing discussion, the present disclosure utilizes a variety of terms to describe features and benefits of the expressive audio generation system. Additional detail is now provided regarding examples of these terms. As mentioned above, the expressive audio generation system can generate expressive audio for an input text. Expressive audio can include digital audio. For example, expressive audio can include digital audio that incorporates one or more style features. For example, expressive audio can include speech having one or more vocalized style features but can also include other expressive audible noises. Speech can include vocalized digital audio. For example, speech can include synthesized vocalized digital audio generated from an input text or recorded vocalized digital audio that corresponds to the input text. Speech can also include various combinations of segments of synthesized vocalized digital audio and/or recorded vocalized digital audio. Speech can further include one or more vocalized style features that correspond to one or more style features associated with an input text.

In one or more embodiments, a speaker identify includes a character of a voice represented within speech. For example, a speaker identity can include an expressiveness or style associated with a speaker represented within speech. For example, a speaker identify can include the identity of a particular speaker or a character of a speaker composed of a collection of qualities or characteristics. Relatedly, in some embodiments, speaker-based input includes user input corresponding to a speaker identity. In particular, speaker-based input can refer to one or more values that are provided (e.g., selected or otherwise input) by a user and are associated with a speaker. For example, speaker-based input can refer to user input (e.g., an icon, a name, etc.) that identifies a particular speaker (e.g., that uniquely identifies the particular speaker from among several available speakers). Further, speaker-based input can include user input that corresponds to one or more characteristics of a speaker (e.g., age, gender, etc.). In some instances, speaker-based input includes a sample of speech (e.g., an audio recording of speech to be mimicked).

In some instances, an input text includes a segment of digital text. For example, an input text can include a segment of digital text that has been identified (e.g., accessed, received, etc.) for generation of expressive audio. Indeed, an input text can include a segment of digital text used as input by a system (e.g., the expressive audio generation system) for output (e.g., generation) of corresponding expressive audio. To illustrate, an input text can include a segment of digital text that has been digitally generated (e.g., typed or drawn), digitally reproduced, or otherwise digitally rendered and used for generation of corresponding expressive audio.

An input text can include a plurality of words and an associated plurality of characters. A character can include a digital glyph. For instance, a character can include a digital graphic symbol representing a single unit of digital text. To provide some examples, a character can include a letter or other symbol that is readable or otherwise contributes to the meaning of digital text. But a character is not so limited. Indeed, a character can also include a punctuation mark or other symbol within digital text. Further, a character can include a phoneme associated with a letter or other symbol. Relatedly, a word can include a group of one or more characters. In particular, a word can include a group of one or more characters that result in a distinct element of speech or writing.

In one or more embodiments, input text is part of a block of text. A block of text can include a group of multiple segments of digital text. For example, a block of text can include a group of related segments of digital text. To illustrate, a block of text can include a paragraph of digital text or multiple sentences from the same paragraph of digital text, a page of digital text or multiple paragraphs from the same page of digital text, a chapter or section of digital text, or the entirety of the digital text (e.g., all digital text within a document). In many instances, a block of text includes a portion of text that is larger than an input text and includes the input text. For example, where an input text includes a portion of a sentence, a block of text can include the sentence itself. As another example, where an input text includes a sentence, a block of text can include a paragraph, or page that includes the sentence.

As mentioned above, the expressive audio generation system can determine contextual word-level style tokens that reflect one or more style features. A style feature can include an audio characteristic or feature associated with an input text. In particular, a style feature can include an audio characteristic of speech determined from a contextual word embedding corresponding to the input text. For example, a style feature can include, but is not limited to, a pitch of speech determined from input text (e.g., an intonation corresponding to the speech), an emotion of speech determined from an input text, a modulation of speech determined from an input text, or a speed of speech determined from an input text.

Additionally, in one or more embodiments, a context-based speech map includes a set of values that represent one or more sounds. For example, a context-based speech map can include an acoustic time-frequency representation of a plurality of sounds across time. The context-based speech map can further represent the sounds based on a context associated with the sounds. In one or more embodiments, the expressive audio generation system generates a context-based speech map that corresponds to an input text and utilizes the context-based speech map to generate expressive audio for the input text as will be discussed in more detail below. For example, a context-based speech map can include an audio spectrogram, such as a Mel spectrogram composed of one or more Mel frames (e.g., one dimensional maps that collectively make up a Mel spectrogram). A context-based speech map can also include a Mel-frequency cepstrum composed of one or more Mel-frequency cepstral coefficients.

In one or more embodiments, a neural network includes a machine learning model that can be tuned (e.g., trained) based on inputs to approximate unknown functions used for generating the corresponding outputs. For example, a neural network can include a model of interconnected artificial neurons (e.g., organized in layers) that communicate and learn to approximate complex functions and generate outputs based on a plurality of inputs provided to the model. For instance, a neural network can include one or more machine learning algorithms. In addition, a neural network can include an algorithm (or set of algorithms) that implements deep learning techniques that utilize a set of algorithms to model high-level abstractions in data. To illustrate, a neural network can include a convolutional neural network, a recurrent neural network (e.g., a long short-term memory (LSTM) neural network), a generative adversarial neural network, and/or a graph neural network.

Additionally, an expressive speech neural network can include a computer-implemented neural network that generates context-based speech maps corresponding to input texts. For example, an expressive speech neural network can include a neural network that analyzes an input text and generates a context-based speech map that captures one or more style features associated with the input text. For example, the expressive speech neural network can include a neural network, such as a neural network having an LSTM neural network model (e.g., an LSTM-based sequence-to-sequence model). In some embodiments, the expressive speech neural network can include one or more attention features (e.g., include one or more attention mechanisms).

Further, a channel can include a path of a neural network through which data is propagated. In particular, a channel can include a pathway of a neural network that includes one or more neural network layers and/or other neural network components that analyze data and generate corresponding values. Where a neural network includes multiple channels, a particular channel of the neural network can analyze different data than another channel of the neural network, analyze the same data differently than the other channel, and/or generate different values than the other channel. In some embodiments, a channel of a neural network is designated for analyzing a particular type or set of data, analyzing data in a particular way, and/or generating a particular type or set of values. For example, a character-level channel can include a channel that analyzes character-level information (e.g., character embeddings) and generates character-level feature vectors. Similarly, a word-level channel can include a channel that analyzes word-level information (e.g., contextual word embeddings) and generates word-level feature vectors. Likewise a speaker identification channel can include a channel that analyzes speaker information (e.g., speaker-based input) and generates speaker identity feature vectors.

In one or more embodiments, a feature vector includes a set of numerical values representing features utilized by a neural network, such as an expressive speech neural network. To illustrate, a feature vector can include a set of values corresponding to latent and/or patent attributes and characteristics analyzed by a neural network (e.g., an input text or speaker-based input). For example, a character-level feature vector can include a set of values corresponding to latent and/or patent attributes and characteristics related to character-level information associated with an input text. Similarly, a word-level feature vector can include a set of values corresponding to latent and/or patent attributes and characteristics related to word-level information associated with an input text. Further, a speaker identity feature vector can include a set of values corresponding to latent and/or patent attributes and characteristics related to speaker-based input.

Additionally, an encoder can include a neural network component that generates encodings related to data. For example, an encoder can refer to a component of a neural network, such as an expressive speech neural network, that can generate encodings related to an input text. To illustrate, a character-level encoder can include an encoder that can generate character encodings. Similarly, a word-level encoder can include an encoder that can generate word encodings.

An encoding can include an encoded value corresponding to an input of a neural network, such as an expressive speech neural network. For example, an encoding can refer to an encoded value corresponding to an input text. To illustrate, a character encoding can include an encoded value related to character-level information of an input text. Similarly, a word encoding can include an encoded value related to word-level information of an input text.

In one or more embodiments, a decoder includes a neural network component that generates outputs of the neural network, such as an expressive speech neural network. For example, a decoder can include a neural network component that can generate outputs based on values generated within the neural network. To illustrate, a decoder can generate neural network outputs (e.g., a context-based speech map) based on feature vectors generated by one or more channels of a neural network.

In one or more embodiments, a character embedding includes a numerical or vector representation of a character. For example, a character embedding can include a numerical or vector representation of a character from an input text. In one or more embodiments, a character embedding includes a numerical or vector representation generated based on an analysis of the corresponding character.

Relatedly, in one or more embodiments, a contextual word embedding includes a numerical or vector representation of a word. In particular, a contextual word embedding can include a numerical or vector representation of a word from an input text that captures the context of the word within the input text. In one or more embodiments, a contextual word embedding includes a numerical or vector representation generated based on an analysis of the corresponding word and/or the input text that includes the corresponding word. For example, in some embodiments, the expressive audio generation system utilizes a contextual word embedding layer of a neural network or other embedding model to analyze a word and/or the associated input text and generate a corresponding contextual word embedding. To illustrate, a contextual word embedding can include a BERT embedding generated using a BERT model or an embedding otherwise generated using another capable embedding model, such as a GloVe model or a Word2Vec model.

In some embodiments, a contextual word embedding captures the context of a word that goes beyond the context provided by the corresponding input text alone. Indeed, in some embodiments, the expressive audio generation system generates a contextual word embedding corresponding to a word using embeddings that capture the context of the word within a larger block of text. In one or more embodiments, a block-level contextual embedding includes a numerical or vector representation of a block of text. In particular, a block-level contextual embedding can include a numerical or vector representation of a block of text that captures contextual values associated with the block of text. In one or more embodiments, a block-level contextual embedding includes a numerical or vector representation generated based on an analysis of the corresponding block of text. As a particular example, a paragraph-level contextual embedding can include a numerical or vector representation generated based on an analysis of a corresponding paragraph of text.

In one or more embodiments, an attention mechanism includes a neural network component that generates values that focus the neural network on one or more features. In particular, an attention mechanism can generate values that focus on a subset of inputs or features based on one or more hidden states. For example, an attention mechanism can generate attention weights (or an attention mask) to emphasize or focus on some features relative to other features reflected in a latent feature vector. Thus, an attention mechanism can be trained to control access to memory, allowing certain features to be stored, emphasized, and/or accessed to more accurately learn the context of a given input. In one or more embodiments, an attention mechanism corresponds to a particular neural network layer and processes the outputs (e.g., the output states) generated by the neural network layer to focus on (i.e. attend to) a particular subset of features.

Relatedly, a multi-head attention mechanism can include an attention mechanism composed of multiple attention components. In particular, a multi-head attention mechanism can include a set of multiple attention components applied to the same neural network layer (i.e., generates values based on the output states generated by the same neural network layer). Each attention component included in the set of multiple attention components can be trained to capture different attention-controlled features or a different set of attention-controlled features that may or may not overlap.

Additionally, a location-sensitive attention mechanism can include an attention mechanism that generates values based on location-based features (e.g., by using attention weights from previous time steps at a particular location within a recurrent neural network). In particular, a location-sensitive attention mechanism can include a neural network mechanism that generates, for a given time step, values based on one or more attention weights from at least one previous time step. For example, a location-based attention mechanism can generate, for a given time step, values using cumulative attention weights from a plurality of previous time steps.

Further, in one or more embodiments, an attention weight includes a value generated using an attention mechanism. In particular, an attention weight can include an attention mechanism weight (e.g., a weight internal to an attention mechanism) that is learned (e.g., generated and/or modified) while tuning (e.g., training) a neural network based on inputs to approximate unknown functions used for generating the corresponding outputs. For example, an attention weight can include a weight internal to a multi-head attention mechanism or a weight internal to a location-sensitive neural network.

In some embodiments, a contextual word-level style token includes a numerical or vector representation of one or more style features of a text. For example, a contextual word-level style token can refer to a numerical or vector representation of one or more style features associated with an input text, generated based on contextual word embeddings associated with the input text. Relatedly, a weighted contextual word-level style token can include a contextual word-level style token having an associated weight value.

Additional detail regarding the expressive audio generation system will now be provided with reference to the figures. For example, FIG. 1 illustrates a schematic diagram of an exemplary system environment ("environment") 100 in which an expressive audio generation system 106 can be implemented. As illustrated in FIG. 1, the environment 100 includes a server(s) 102, a network 108, and client devices 110*a*-110*n*.

Although the environment 100 of FIG. 1 is depicted as having a particular number of components, the environment 100 can have any number of additional or alternative components (e.g., any number of servers, client devices, or other components in communication with the expressive audio generation system 106 via the network 108). Similarly, although FIG. 1 illustrates a particular arrangement of the server(s) 102, the network 108, and the client devices 110*a*-110*n*, various additional arrangements are possible.

The server(s) 102, the network 108, and the client devices 110*a*-110*n* may be communicatively coupled with each other either directly or indirectly (e.g., through the network 108 discussed in greater detail below in relation to FIG. 11). Moreover, the server(s) 102 and the client devices 110*a*-110*n* may include a variety of computing devices (including one or more computing devices as discussed in greater detail with relation to FIG. 11).

As mentioned above, the environment 100 includes the server(s) 102. The server(s) 102 can generate, store, receive, and/or transmit digital data, including expressive audio for input text. For example, the server(s) 102 can receive an input text from a client device (e.g., one of the client devices 110*a*-110*n*) and transmit an expressive audio for the input text to the client device or another client device. In one or more embodiments, the server(s) 102 comprises a data server. The server(s) 102 can also comprise a communication server or a web-hosting server.

As shown in FIG. 1, the server(s) 102 include the text-to-speech system 104. In particular, the text-to-speech system 104 can perform functions related to generating digital audio from digital text. For example, a client device can generate or otherwise access digital text (e.g., using the client application 112). Subsequently, the client device can transmit the digital text to the text-to-speech system 104 hosted on the server(s) 102 via the network 108. The text-to-speech system 104 can employ various methods to generate digital audio for the input text.

Additionally, the server(s) 102 includes the expressive audio generation system 106. In particular, in one or more embodiments, the expressive audio generation system 106 utilizes the server(s) 102 to generate expressive audio for input texts. For example, the expressive audio generation system 106 can utilize the server(s) 102 to identify an input text and generate an expressive audio for the input text.

To illustrate, in one or more embodiments, the expressive audio generation system 106, via the server(s) 102, identifies an input text having a plurality of words. The expressive audio generation system 106, via the server(s) 102, further determines a character-level feature vector based on a plurality of characters associated with the plurality of words using a character-level channel of an expressive speech neural network. Via the server(s) 102, the expressive audio generation system 106 also determines a word-level feature vector based on contextual word embeddings corresponding to the plurality of words using a word-level channel of the expressive speech neural network. Further, the expressive audio generation system 106, via the server(s) 102, uses a decoder of the expressive speech neural network to generate a context-based speech map based on the character-level feature vector and the word-level feature vector. Via the server(s) 102, the expressive audio generation system 106 generates expressive audio for the input text using the context-based speech map.

In one or more embodiments, the client devices 110*a*-110*n* include computing devices that can access digital text and/or digital audio, such as expressive audio. For example, the client devices 110*a*-110*n* can include smartphones, tablets, desktop computers, laptop computers, head-mounted-display devices, or other electronic devices. The client devices 110*a*-110*n* include one or more applications (e.g., the client application 112) that can access digital text and/or digital audio, such as expressive audio. For example, the client application 112 includes a software application installed on the client devices 110*a*-110*n*. Additionally, or alternatively, the client application 112 includes a software application hosted on the server(s) 102, which may be accessed by the client devices 110*a*-110*n* through another application, such as a web browser.

The expressive audio generation system 106 can be implemented in whole, or in part, by the individual elements of the environment 100. Indeed, although FIG. 1 illustrates the expressive audio generation system 106 implemented with regard to the server(s) 102, different components of the expressive audio generation system 106 can be implemented by a variety of devices within the environment 100. For example, one or more (or all) components of the expressive audio generation system 106 can be implemented by a different computing device (e.g., one of the client devices 110*a*-110*n*) or a separate server from the server(s) 102 hosting the text-to-speech system 104. Example components of the expressive audio generation system 106 will be described below with regard to FIG. 9.

Figure 2:
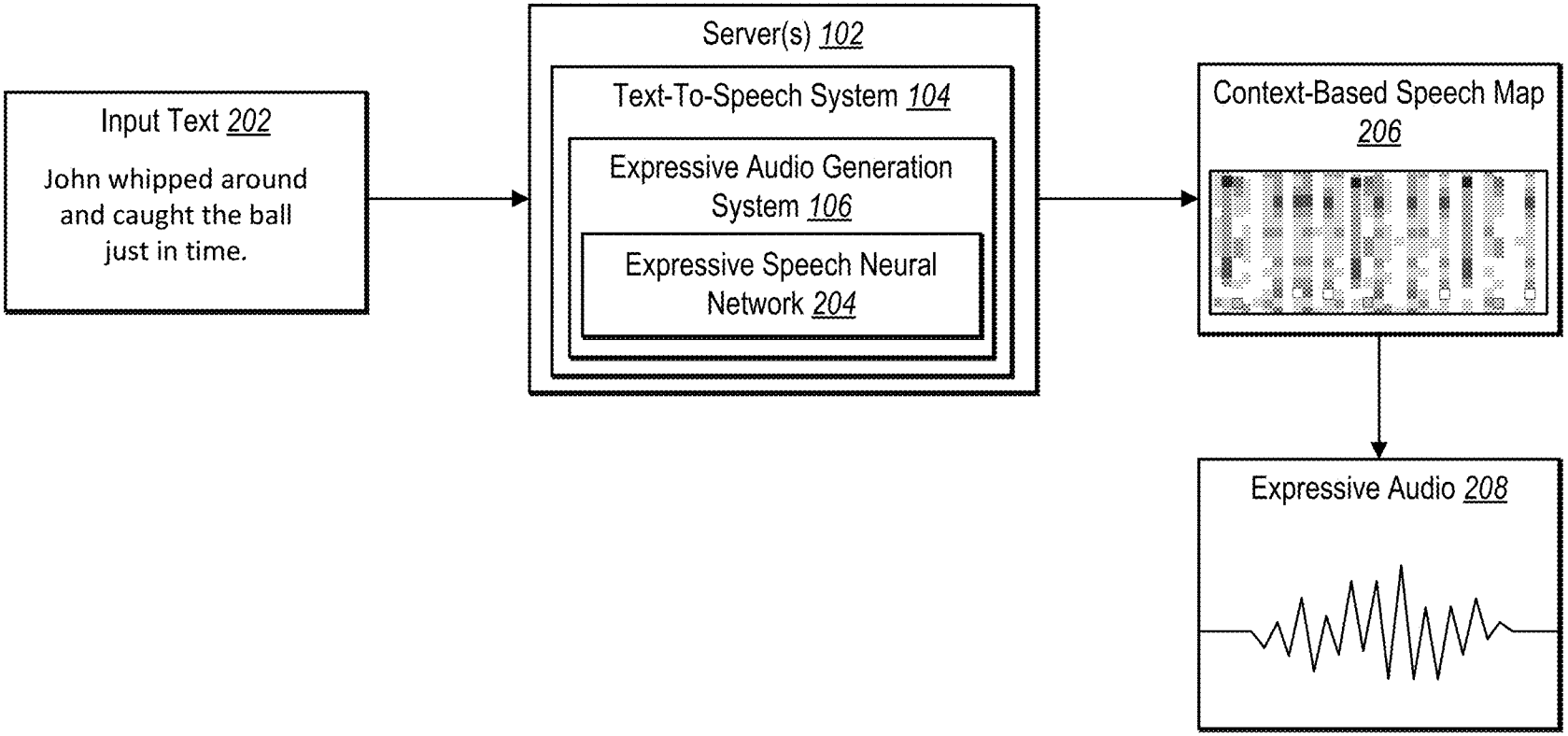
FIG. 2 illustrates a block diagram of the expressive audio generation system generating expressive audio for an input text in accordance with one or more embodiments.

As mentioned above, the expressive audio generation system 106 generates expressive audio for an input text. FIG. 2 illustrates a block diagram of the expressive audio generation system 106 generating expressive audio for an input text in accordance with one or more embodiments.

As shown in FIG. 2, the expressive audio generation system 106 identifies an input text 202. In one or more embodiments, the expressive audio generation system 106 identifies the input text 202 by receiving the input text 202 from a computing device (e.g., a third-party system or a client device). In some embodiments, however, the expressive audio generation system 106 identifies the input text 202 by accessing a database storing digital texts. For example, the expressive audio generation system 106 can maintain a database and store a plurality of digital texts therein. In some instances, an external device or system stores digital shapes for access by the expressive audio generation system 106.

As further shown in FIG. 2, the input text 202 includes a plurality of words. Further, the input text 202 includes a plurality of characters associated with the plurality of words, including punctuation. In one or more embodiments, the input text 202 is part of a larger block of text (e.g., the input text 202 is a sentence from a paragraph), which will be discussed in more detail below with regard to FIG. 3B.

As illustrated in FIG. 2, the expressive audio generation system 106 generates a context-based speech map 206 corresponding to the input text 202. In particular, the expressive audio generation system 106 utilizes an expressive speech neural network 204 to generate the context-based speech map 206 based on the input text 202. In one or more embodiments, the expressive speech neural network 204 includes a multi-channel deep learning architecture that can analyze character-level information and word-level information of the input text 202 separately. The architecture of the expressive speech neural network 204 will be discussed in more detail below with reference to FIGS. 4A-4B. In one or more embodiments, the context-based speech map includes a representation of one or more style features associated with the input text 202.

As further illustrated in FIG. 2, the expressive audio generation system 106 can generate expressive audio 208 for the input text. In particular, the expressive audio generation system 106 can generate the expressive audio 208 using the context-based speech map 206. Accordingly, the expressive audio 208 can incorporate the one or more style features associated with the input text 202.

Figure 3A:
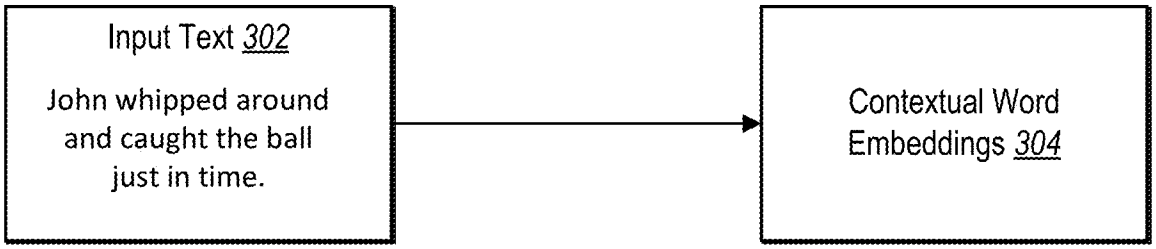
FIGS. 3A-3B illustrate block diagrams for generating contextual word embeddings in accordance with one or more embodiments.
Figure 3B:
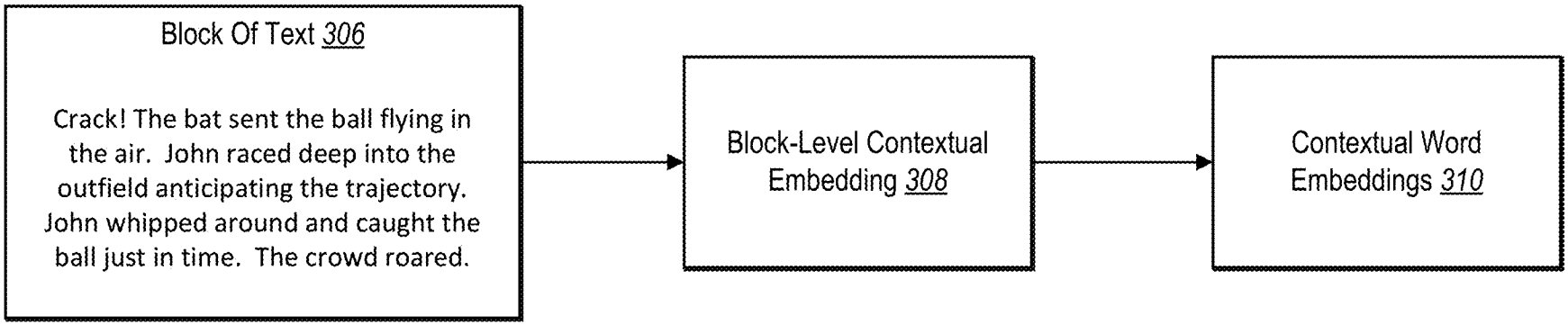

As previously mentioned, the expressive audio generation system 106 can utilize a word-level channel of an expressive speech neural network to generate a word-level feature vector based on contextual word embeddings corresponding to a plurality of words of an input text. In some embodiments, the expressive audio generation system 106 generates the contextual word embeddings based on the input text. FIGS. 3A-3B illustrate block diagrams for generating contextual word embeddings in accordance with one or more embodiments.

Indeed, as shown in FIG. 3A, the expressive audio generation system 106 generates contextual word embeddings 304 based on the input text 302. In one or more embodiments, the contextual word embeddings 304 include one or more contextual word embeddings corresponding to each word of the input text 302. In some embodiments, the contextual word embeddings 304 include pre-trained contextual word embeddings. In other words, the expressive audio generation system 106 can utilize a pre-trained embedding model to generate the contextual word embeddings 304 from the input text 302 (e.g., expressive audio generation system 106 can pre-train the contextual word embeddings 304 on plain text data). As described above, the expressive audio generation system 106 can utilize various embeddings models—such as a BERT model, a GloVe model, or a Word2Vec model—to generate the contextual word embeddings 304. Indeed, in one or more embodiments, the expressive audio generation system 106 generates the contextual word embeddings 304 as described in Jacob Devlin et al., *BERT: Pre-training of Deep Bidirectional Transformers for Language Understanding,* 2018, https://arxiv.org/abs/1810.04805, which is incorporated herein by reference in its entirety.

As discussed above, in some embodiments, the expressive audio generation system 106 generates the contextual word embeddings for an input text to capture the context of a block of text that includes that input text. For example, as shown in FIG. 3B, the expressive audio generation system 106 generates a block-level contextual embedding 308 corresponding to the block of text 306. Indeed, as shown in FIG. 3B, the block of text 306 includes the input text 302 from FIG. 3A. Thus, the expressive audio generation system 106 can generate the block-level contextual embedding 308 to capture the context provided for the input text 302 (e.g., provided for the plurality of words of the input text 302) by the larger block of text 306. To provide an example, where the block of text 306 represents a paragraph that includes the input text 302, the block-level contextual embedding 308 can include a paragraph-level contextual embedding that captures the context provided for the input text 302 (e.g., provided for the plurality of words of the input text 302) by the paragraph. In one or more embodiments, the expressive audio generation system 106 generates the block-level contextual embedding 308 using one of the models discussed above with respect to generating the contextual word embedding 304 of FIG. 3A.

As shown in FIG. 3B, the expressive audio generation system 106 further generates the contextual word embeddings 310 based on the block-level contextual embedding 308. In particular, the expressive audio generation system 106 can pull word-level embeddings from the block-level embeddings. Using this approach, the expressive audio generation system 106 can increase the context (e.g., the amount of information regarding surrounding meaning and usage) in generating the contextual word embeddings 310. In other words, the expressive audio generation system 106 can generate the contextual word embeddings 310 to capture the context provided by the block of text 306.

As an example, in one or more embodiments, the expressive audio generation system 106 utilizes a model (e.g., a neural network, such as an LSTM) to generate the block-level contextual embedding 308 for the block of text 306. The expressive audio generation system 106 can further utilize an additional model (e.g., an additional neural network) to generate the contextual word embedding corresponding to a given word from the input text 302 based on the block-level contextual embedding 308. For example, the expressive audio generation system 106 can provide the block-level contextual embedding 308 and the word to the additional model as inputs for generating the corresponding contextual word embedding. In some embodiments, the expressive audio generation system 106 utilizes the additional model to generate the contextual word embedding for a given word by processing the block-level contextual embedding 308 and providing, as output, values (e.g., a feature vector) that correspond to the given word.

Figure 4A:
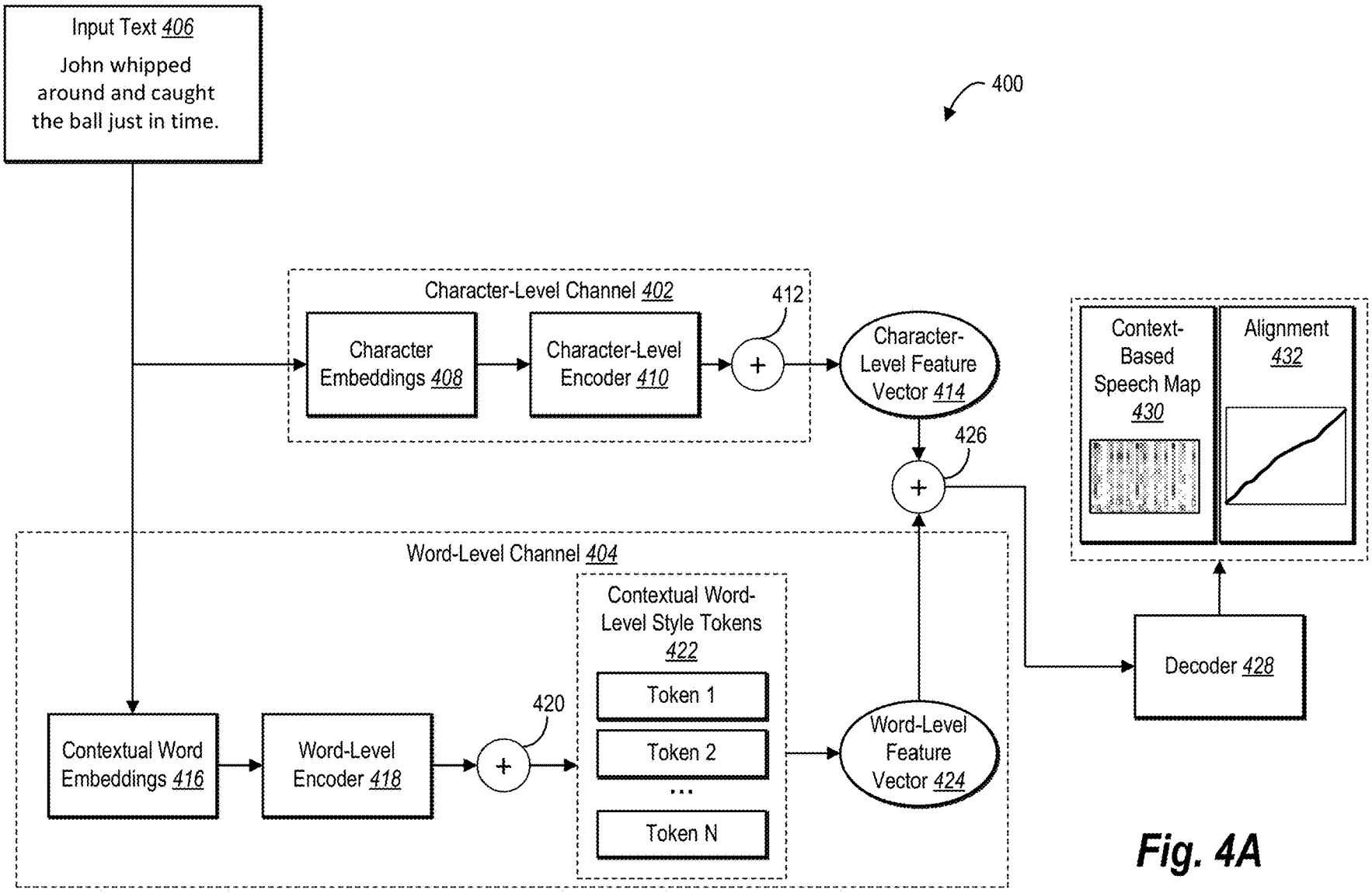
FIGS. 4A-4B illustrate schematic diagrams of an expressive speech neural network in accordance with one or more embodiments.
Figure 4B:
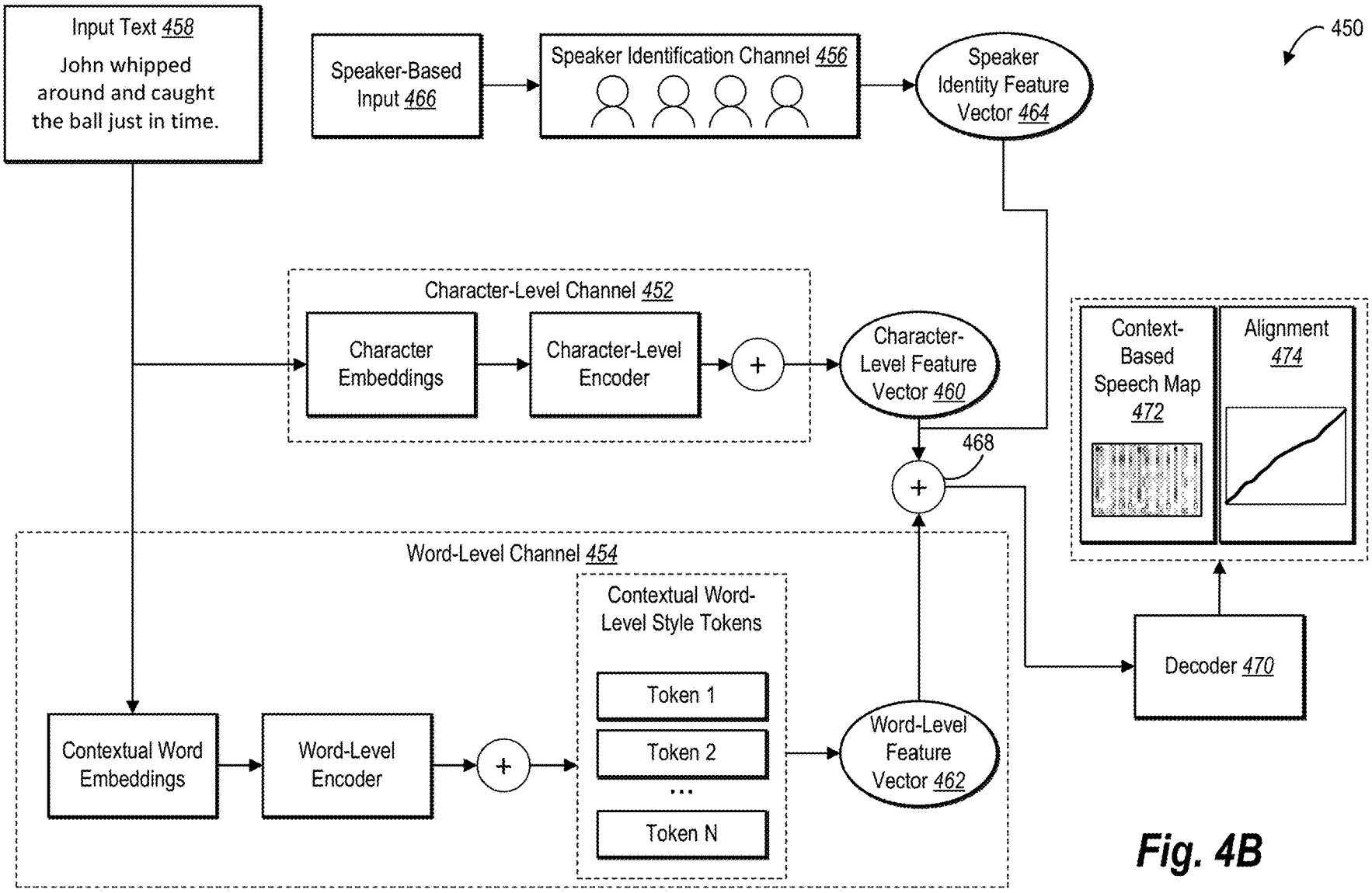

As discussed above, the expressive audio generation system 106 can utilize an expressive speech neural network to generate a context-based speech map corresponding to an input text. FIGS. 4A-4B illustrate schematic diagrams of an expressive speech neural network in accordance with one or more embodiments.

In particular, FIG. 4A illustrates an expressive speech neural network 400 having a character-level channel 402 and a word-level channel 404. Accordingly, the expressive audio generation system 106 can generate a context-based speech map 430 corresponding to an input text 406 utilizing the character-level channel 402 and the word-level channel 404 of the expressive speech neural network 400. For example, in one or more embodiments, the expressive speech neural network 400 utilizes the character-level channel 402 to learn the pronunciations of the words of the input text 406. Further, the expressive speech neural network 400 can utilize the word-level channel 404 to learn style features associated with the input text 406 based on a context associated with the input text 406. In one or more embodiments, the expressive speech neural network 400 analyzes the input text 406 as a sequence of characters.

For example, as shown in FIG. 4A, the character-level channel 402 of the expressive speech neural network 400 can generate character embeddings 408 corresponding to a plurality of characters of the input text 406. Indeed, in some embodiments, the character-level channel 402 includes a character embedding layer that generates the character embeddings. The character-level channel 402 can generate the character embeddings 408 by converting the sequence of characters from the input text 406 to a sequence of vectors using a set of trainable embeddings (e.g., using a character embedding layer or other neural network that is trained—as will be discussed in more detail below with reference to FIG. 5—to generate character embeddings corresponding to characters). In one or more embodiments, the expressive audio generation system 106 generates the character embeddings 408 pre-network and provides the character embeddings 408 to the character-level channel 402 of the expressive speech neural network 400.

As shown in FIG. 4A, the character-level channel 402 can utilize a character-level encoder 410 to generate character encodings based on the character embeddings 408. For example, in one or more embodiments, the character-level encoder 410 includes a convolution stack (e.g., a stack of one-dimensional convolutional layers followed by batch normalization layers and ReLU activation layers). Indeed, the character-level encoder 410 can utilize the convolutional layers of the convolution stack to model longer-term context (e.g., N-grams) in the input character sequence from the input text 406. The character-level encoder 410 can process the character embeddings 408 through the convolutional stack.

In some embodiments, the character-level encoder 410 further includes a bi-directional LSTM. For example, the character-level encoder 410 can include a single bi-directional LSTM layer. The character-level encoder 410 can provide the output of the final convolutional layer of the convolution stack to the bi-directional LSTM to generate corresponding character encodings.

As shown in FIG. 4A, the character-level channel 402 can utilize an attention mechanism 412 to generate a character-level feature vector 414 corresponding to the plurality of characters of the input text 406 based on the generated character encodings. In particular, the attention mechanism 412 can summarize the full encoded sequence generated by the character-level encoder 410 as a fixed-length vector for each time step. In one or more embodiments, the attention mechanism 412 includes a location-sensitive attention mechanism that generates the character-level feature vector 414 based on the character encodings and attention weights from previous time steps. In particular, the attention mechanism 412 can utilize cumulative attention weights from the previous time steps as an additional feature in generating the character-level feature vector 414.

As further shown in FIG. 4A, the word-level channel 404 of the expressive speech neural network 400 can generate contextual word embeddings 416 corresponding to a plurality of words of the input text 406. Indeed, in some embodiments, the word-level channel 404 includes a word embedding layer that generates the contextual word embeddings 416. In one or more embodiments, the word-level channel 404 generates the contextual word embeddings 416 as described above with reference to FIG. 3A or with reference to FIG. 3B. In some instances, the expressive audio generation system 106 generates the contextual word embeddings 416 pre-network and provides contextual word embeddings 416 to the word-level channel 404 of the expressive speech neural network 400.

As shown in FIG. 4A, the word-level channel 404 can utilize a word-level encoder 418 to generate contextual word encodings based on the contextual word embeddings 416. For example, the word-level encoder 418 can include one or more bi-directional LSTM layers that generates one or more hidden state vectors from the contextual word embeddings 416. To illustrate, in some instances, the word-level encoder 418 utilizes a first bi-directional LSTM layer to analyze each contextual word embedding from the contextual word embeddings 416 (e.g., in sequence and in a reverse sequence) and generate a first hidden state vector. The word-level encoder 418 can further utilize a second bi-directional LSTM layer to analyze the values of the first hidden state vector (e.g., in sequence and in a reverse sequence) and generate a second hidden state vector and so forth until a final bi-directional LSTM layer generates a final hidden state vector. The word-level channel 404 can utilize the final hidden state vector to summarize the context of the input text 406. In other words, the final hidden state vector generated by the word-level encoder 418 can include the contextual word encodings corresponding to the contextual word embeddings 416.

As shown in FIG. 4A, the word-level channel 404 can further utilize an attention mechanism 420 to generate contextual word-level style tokens 422 based on the generated contextual word encodings. In one or more embodiments, the attention mechanism 420 includes a multi-head attention mechanism that attends the contextual word encodings over a set of n trainable contextual word-level style tokens.

In one or more embodiments, the word-level channel 404 generates the contextual word-level style tokens 422 to factorize an overall style associated with the input text 406 into a plurality of fundamental styles. In other words, as described above, the contextual word-level style tokens 422 can correspond to one or more style features associated with the input text 406. Indeed, without explicitly labeling these tokens in training, the word-level channel 404 can generate the contextual word-level style tokens 422 to represent/capture different styles of speech represented within the input text 406, such as high pitch versus low pitch. In some embodiments, the contextual word-level style tokens 422 include weighted contextual word-level style tokens (i.e., are associated with weight values). Indeed, in some embodiments, the expressive audio generation system 106 enables the manual alteration of the weights associated with each contextual word-level style token.

To provide an example, in one or more embodiments, the word-level channel 404 utilizes the word-level encoder 418 to generate a fixed-length vector that includes the contextual word encodings. The word-level channel 404 utilizes the fixed-length vector as a query vector to the attention mechanism 420. In some embodiments, the expressive audio generation system 106 trains the attention mechanism 420 to learn a similarity measure between contextual word encodings and each token in a bank of randomly initialized values. The word-level channel 404 can utilize the attention mechanism 420 generate the contextual word-level style tokens 422 (e.g., the weighted contextual word-level style tokens) generating a set of weights that represent the contribution of each token from the bank of randomly initialized values. In other words, rather than generating the contextual word-level style tokens 422 themselves, the attention mechanism 420 generates weights for a bank of contextual word-level style tokens 422 that were previously initialized.

As suggested above, the word-level channel 404 can learn to generate the weights for the contextual word-level style tokens 422 without using labels during training. Indeed, as will be described in more detail below with reference to FIG. 5, the word-level channel 404 (e.g., the attention mechanism 420) can learn to generate the weights for the contextual word-level style tokens 422 as the expressive audio generation system 106 trains the expressive speech neural network 400 to generate context-based speech maps. For example, in some embodiments, during the training process, the word-level channel 404 learns to pool similar features together and utilizes the contextual word-level style tokens 422 to represent the pools of similar features.

In one or more embodiments, the expressive audio generation system 106 utilizes the word-level channel 404 to generate the contextual word-level style tokens 422 as described in Yuxuan Wang et al., *Style Tokens: Unsupervised Style Modeling, Control and Transfer in End-to-end Speech Synthesis,* 2018, https://arxiv.org/abs/1803.09017, which is incorporated herein by reference in its entirety.

As shown in FIG. 4A, the word-level channel 404 generates a word-level feature vector 424 that corresponds to the plurality of words of the input text 406 based on the contextual word-level style tokens 422. For example, the word-level channel 404 can generate the word-level feature vector 424 based on a weighted sum of the contextual word-level style tokens 422.

Further, as shown in FIG. 4A, the expressive speech neural network 400 combines the character-level feature vector 414 and the word-level feature vector 424 (as shown by the combination operator 426). For example, the expressive speech neural network 400 can concatenate the character-level feature vector 414 and the word-level feature vector 424.

Additionally, as shown in FIG. 4A, the expressive speech neural network 400 further utilizes a decoder 428 to generate a context-based speech map 430 based on the combination (e.g., the concatenation) of the character-level feature vector 414 and the word-level feature vector 424. In one or more embodiments, the decoder 428 includes an autoregressive neural network that generates one portion of the context-based speech map 430 per time step (e.g., where the context-based speech map includes a Mel spectrogram, the decoder 428 generates one Mel frame per time step).

In one or more embodiments, for a given time step, the expressive speech neural network 400 passes the portion of the context-based speech map 430 generated for the previous time step through a pre-network component (not shown) that includes a plurality of fully-connected layers. The expressive speech neural network 400 further combines (e.g., concatenates) the output of the pre-network component with the character-level feature vector 414 and/or the word-level feature vector 424 and passes the resulting combination through a stack of uni-directional LSTM layers (e.g., included in the decoder 428). Additionally, the expressive speech neural network 400 combines (e.g., concatenates) the output of the LSTM layers with the character-level feature vector 414 and/or the word-level feature vector 424 and projects the resulting combination through a linear transform (e.g., included in the decoder 428) to generate the portion of the context-based speech map 430 for that time step.

In one or more embodiments, the expressive speech neural network 400 utilizes a stop token to determine when the context-based speech map 430 has been completed. For example, while generating the portions of the context-based speech map 430, the expressive speech neural network 400 can project the combination of the LSTM output from the decoder 428 and the character-level feature vector 414 and/or the word-level feature vector 424 down to a scalar. The expressive speech neural network 400 can pass the projected scalar through a sigmoid activation to determine the probability that the context-based speech map 430 has been completed (e.g., that the input text 406 has been fully processed).

In some embodiments, the expressive audio generation system 106 further provides the context-based speech map 430 to a post-network component (not shown) to enhance the context-based speech map 430. For example, the expressive audio generation system 106 can utilize a convolutional post-network component to generate a residual and add the residual to the context-based speech map 430 to improve the overall reconstruction.

In one or more embodiments, the context-based speech map 430 represents the expressiveness of the input text 406. In particular, the context-based speech map 430 can incorporate one or more style features associated with the input text 406. For example, the context-based speech map 430 can incorporate the one or more style features corresponding to the contextual word-level style tokens 422.

As shown in FIG. 4A, the expressive audio generation system 106 further utilizes the expressive speech neural network 400 to generate an alignment 432. In one or more embodiments, the alignment 432 includes a visualization of values generated by the expressive speech neural network 400 as it processes the input text 406. For example, in some embodiments, the alignment 432 displays a representation of feature vectors that are utilized by the decoder 428 in generating a portion of the context-based speech map 430 for a given time step. In particular, the y-axis of the alignment can represent feature vectors generated by one or more of the channels of the expressive speech neural network 400 (or a combination of the feature vectors) and the x-axis can represent the time-steps of the decoder. Collectively, the alignment 432 can show which of the feature vectors (or which combinations of feature vectors) are given greater weight when generating a portion of context-based speech map 430 (e.g., where, for each time step, the decoder 428 analyzes all available feature vectors or combinations of feature vectors).

As mentioned previously, the expressive audio generation system 106 can also utilize an expressive speech neural network that includes a speaker identification channel. For example, FIG. 4B illustrates an expressive speech neural network 450 having a character-level channel 452, a word-level channel 454, and a speaker identification channel 456. As shown, the character-level channel 452 can generate a character-level feature vector 460 corresponding to a plurality of characters of an input text 458 as discussed above with reference to FIG. 4A. Further, the word-level channel 454 can generate a word-level feature vector 462 corresponding to a plurality of words of the input text 458 as discussed above with reference to FIG. 4A.

Further, as shown in FIG. 4B, the speaker identification channel 456 can generate a speaker identity feature vector 464 based on speaker-based input 466. Indeed, in one or more embodiments, the expressive audio generation system 106 provides the speaker-based input 466 to the expressive speech neural network 450 along with the input text 458 to generate expressive audio that captures the style (e.g., sound, tonality, etc.) of a particular speaker. As mentioned above, the speaker-based input 466 can identify a particular speaker from among a plurality of available speakers, include details describing the speaker (e.g., age, gender, etc.), or include a sample of speech to be mimicked. In one or more embodiments, the speaker-based input 466 can include, or be associated with, a particular language or accent to be incorporated into the resulting expressive audio. In some embodiments, the speaker identification channel 456 utilizes a plurality of fully-connected layers to generate the speaker identity feature vector 464 based on the speaker-based input 466.

For example, in one or more embodiments, the speaker identification channel 456 utilizes a vector-based speaker embedding model. For example, the speaker identification channel 456 can include a d-vector speaker embedding model that includes a deep neural network having a plurality of fully-connected layers to extract frame-level vectors from the speaker-based input 466 and average the frame-level vectors to obtain the speaker identity feature vector 464. In some embodiments, the speaker identification channel 456 utilizes a Siamese neural network. In particular the Siamese neural network can include a dual encoder network architecture having two encoders that share the same weights and are trained to learn the same function(s) that encode(s) speaker-based inputs based on minimizing the distance between similar input speech samples.

As shown in FIG. 4B, the expressive speech neural network 450 combines the character-level feature vector 460, the word-level feature vector 462, and the speaker identity feature vector 464 (as shown by the combination operator 468). For example, the expressive speech neural network 450 can concatenate the character-level feature vector 460, the word-level feature vector 462, and the speaker identity feature vector 464. Further, the expressive speech neural network 450 can utilize the decoder 470 to generate the context-based speech map 472. Further, the expressive speech neural network 450 can utilize the decoder 470 to generate the alignment 474.

In one or more embodiments, the expressive audio generation system 106 utilizes the expressive speech neural network to generate a context-based speech map using additional or alternative user input. For example, the expressive audio generation system 106 can provide input (e.g., user input) to the expressive speech neural network regarding features to be incorporated into the resulting expressive audio that cannot be captured from the input text alone. To illustrate, the expressive audio generation system 106 can provide input regarding an explicit context associated with the input text (e.g., a context, such as an emotion, to supplement the context captured by the expressive speech neural network by analyzing the input text).

Thus, the expressive audio generation system 106 can generate a context-based speech map corresponding to an input text. In particular, the expressive audio generation system 106 can utilize an expressive speech neural network to generate the context-based speech map. The algorithms and acts described with reference to FIGS. 4A-4B can comprise the corresponding structure for performing a step for generating a context-based speech map from contextual word embeddings of the plurality of words of the input text and the character-level feature vector. Additionally, the expressive speech neural network architectures described with reference to FIGS. 4A-4B can comprise the corresponding structure for performing a step for generating a context-based speech map from contextual word embeddings of the plurality of words of the input text and the character-level feature vector.

Figure 5:
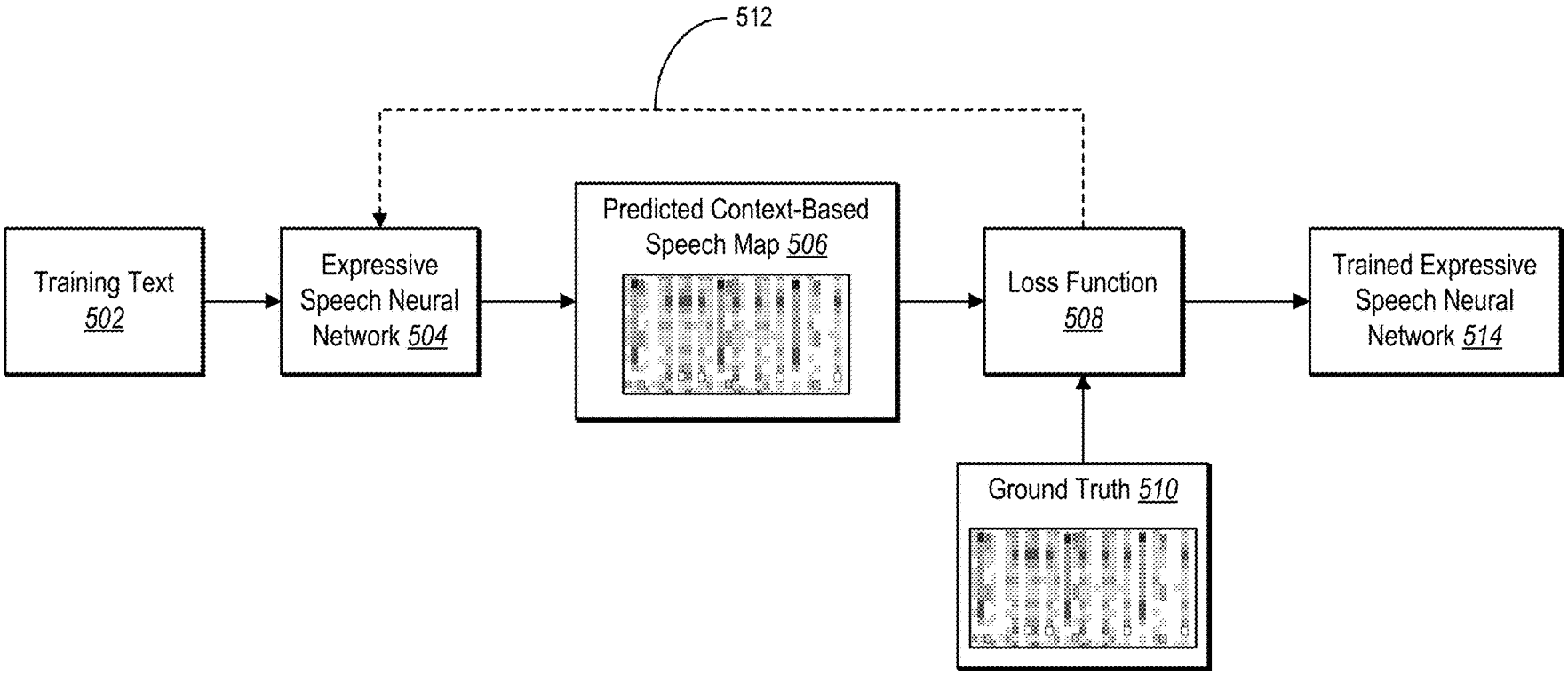
FIG. 5 illustrates a block diagram for training an expressive speech neural network in accordance with one or more embodiments.

As suggested above, the expressive audio generation system 106 can train an expressive speech neural network to generate context-based speech maps that correspond to input texts. FIG. 5 illustrates a block diagram of the expressive audio generation system 106 training an expressive speech neural network in accordance with one or more embodiments. In particular, FIG. 5 illustrates a single iteration from an iterative training process.

As shown in FIG. 5, the expressive audio generation system 106 implements the training by providing a training text 502 to the expressive speech neural network 504. The training text 502 includes a plurality of words and a plurality of associated characters. Further, as shown, the expressive audio generation system 106 utilizes the expressive speech neural network 504 to generate a predicted context-based speech map 506 based on the training text 502. Indeed, the expressive audio generation system 106 can utilize the expressive speech neural network 504 to generate the predicted context-based speech map 506 as discussed above with reference to FIGS. 3A-3B.

The expressive audio generation system 106 can utilize the loss function 508 to determine the loss (i.e., error) resulting from the expressive speech neural network 504 by comparing the predicted context-based speech map 506 with a ground truth 510 (e.g., a ground truth context-based speech map). The expressive audio generation system 106 can back propagate the determined loss to the expressive speech neural network 504 (as shown by the dashed line 512) to optimize the model by updating its parameters/weights. In particular, the expressive audio generation system 106 can back propagate the determined loss to each channel of the expressive speech neural network 504 (e.g., the character-level channel, the word-level channel, and, in some instances, the speaker identification channel) as well as the decoder of the expressive speech neural network 504 to update the respective parameters/weights of that channel. In some embodiments, the expressive audio generation system 106 back propagates the determined loss to each component of the expressive speech neural network (e.g., the character-level encoder, the word-level encoder, the location-sensitive attention mechanism, etc.) update the parameters/weights of that component individually. Consequently, with each iteration of training, the expressive audio generation system 106 gradually improves the accuracy with which the expressive speech neural network 504 can generate context-based speech maps for input texts (e.g., by lowering the resulting loss value). As shown, the expressive audio generation system 106 can thus generate the trained expressive speech neural network 514.

As suggested above, in one or more embodiments, the expressive audio generation system 106 utilizes pre-trained contextual word embeddings; thus, the expressive audio generation system 106 does not update the neural network component (e.g., a word embedding layer) utilized to generate the contextual word embeddings. As shown, the expressive audio generation system 106 can thus generate the trained expressive audio generation system 106.

Figure 6:
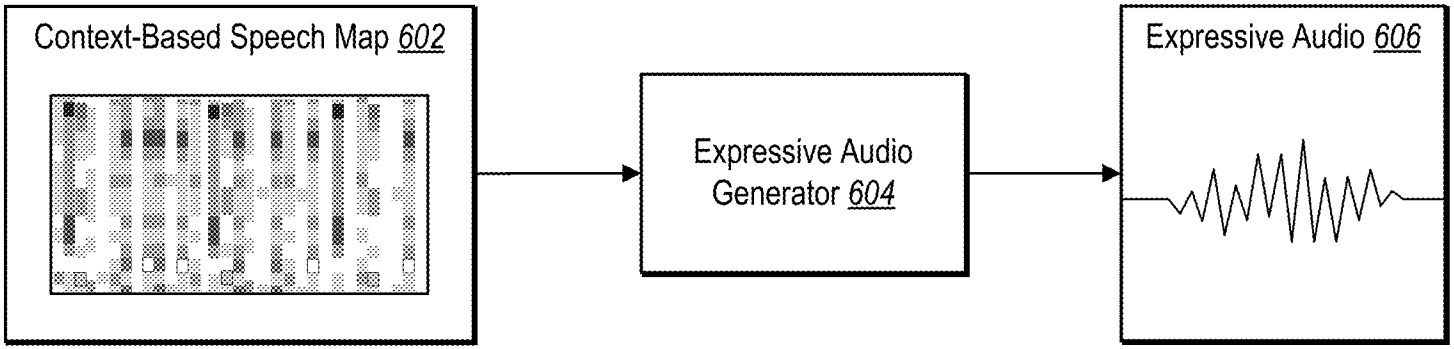
FIG. 6 illustrates a block diagram for generating expressive audio in accordance with one or more embodiments.

As discussed above, the expressive audio generation system 106 can generate expressive audio for an input text. FIG. 6 illustrates a block diagram for generating expressive audio in accordance with one or more embodiments. Indeed, as shown in FIG. 6, the expressive audio generation system 106 utilizes a context-based speech map 602 to generate expressive audio 606 for an input text.

In particular, as shown in FIG. 6, the expressive audio generation system 106 utilizes an expressive audio generator 604 to generate the expressive audio 606 based on the context-based speech map 602. In one or more embodiments, the expressive audio generator 604 includes a vocoder, such as a Griffin-Lim model, a WaveNet model, or a WaveGlow model. For example, in some embodiments, the expressive audio generation system 106 utilizes a vocoder to generate the expressive audio 606 as described in Ryan Prenger et al., *Waveglow: A Flow-based Generative Network for Speech Synthesis*, IEEE International Conference on Acoustics, Speech and Signal Processing (ICASSP), 2019, which is incorporated herein by reference in its entirety.

In one or more embodiments, the expressive audio 606 captures one or more style features of the corresponding input text. In particular, the expressive audio 606 can convey the expressiveness of the corresponding input text. Indeed, by generating the expressive audio 606 using based on the context-based speech map 602 (e.g., generated as described above with reference to FIGS. 4A-4B), the expressive audio generation system 106 can capture, within the expressive audio 606, the style and expressiveness suggest by the context of the input text.

Accordingly, the expressive audio generation system 106 operates more flexibly than conventional systems. In particular, the expressive audio generation system 106 can utilize word-level information associated with an input text to capture the context of the input text. The expressive audio generation system 106 can incorporate styles features that are indicated by that context within the expressive audio generated for the input text. Thus, the expressive audio generation system 106 is not limited to generating audio based on the character-level information of an input text as are many conventional systems.

Further, the expressive audio generation system 106 operates more accurately than conventional systems. Indeed, by analyzing word-level information and capturing the associated context, the expressive audio generation system 106 can generate expressive audio that more accurately conveys the expressiveness of an input text. For example, the expressive audio generation system 106 can generate expressive audio that accurately incorporates the pitch, the emotion, and the modulation that is suggested by the context of the input text.

As mentioned above, utilizing an expressive speech neural network that analyzes the word-level information of an input text separate from the character-level information can allow the expressive audio generation system 106 to more accurately generate expressive audio for an input text. Researchers have conducted studies to determine the accuracy of an embodiment of the expressive audio generation system 106 in generating expressive audio. In particular, the researchers compared performance of one embodiment of the expressive audio generation system 106 with the Tacotron 2 text-to-speech model. The researchers trained both of the models on the LJ Speech dataset. The researchers further measured performance using various approaches as will be shown. FIGS. 7-8 each illustrate a table reflecting experimental results regarding the effectiveness of the expressive audio generation system 106 in accordance with one or more embodiments.

For example, FIG. 7 illustrates a table representing the word error rate resulting from performance of the embodiment of the expressive audio generation system 106 (labeled as "proposed model") compared to the word error rate resulting from performance of the Tacotron 2 text-to-speech model. For the experiment, the researchers utilized each model to generate voice output for eight paragraphs—approximately eighty words each—from various literary novels. To measure the pronunciation errors, the researchers converted the voice output from both models back to text using a speech-to-text converter. The researchers then measured the word error rate of the output text using standard automatic speech recognition ("ASR") tools.

As shown by the results presented in the table of FIG. 7, the embodiment of the tested expressive audio generation system 106 outperforms the Tacotron 2 text-to-speech model. Thus, the expressive audio generation system 106 can generate expressive audio that more accurately captures the words (e.g., the pronunciation of the words) from an input text than conventional systems.

FIG. 8 illustrates a table reflecting quality of speech ("QOS") comparisons between the embodiment of the expressive audio generation system 106 and the Tacotron 2 text-to-speech model. For this experiment, the researchers conducted a survey with twenty-five individuals to evaluate performance of the models. Each participant evaluated performance across two sentences that were randomly selected from a group of ten sentences, yielding a total of fifty responses with each tested sentence being evaluated by five participants.

The researchers provided each participant with the selected sentences as well as the voice outputs generated by the tested models for those sentences, randomizing the sequence of presentation to the participants in order to avoid bias. After listening to voice outputs generated by the model, the participants selected the output they perceived to better represent the corresponding sentence or selected "Neutral" if they perceived the voice outputs to be the same. The researchers collected evaluations of several metrics from the participants.

As shown by the results presented in the table of FIG. 8, the tested embodiment of the expressive audio generation system 106 outperforms the Tacotron 2 text-to-speech model in every measured metric. Notably, the expressive audio generation system 106 was perceived to provide more correct intonation and better emotional context in its voice outputs by a majority of the participants. Thus, as shown, the expressive audio generation system 106 can generate expressive audio that more accurately captures the expressiveness of an input text.

Figure 9:
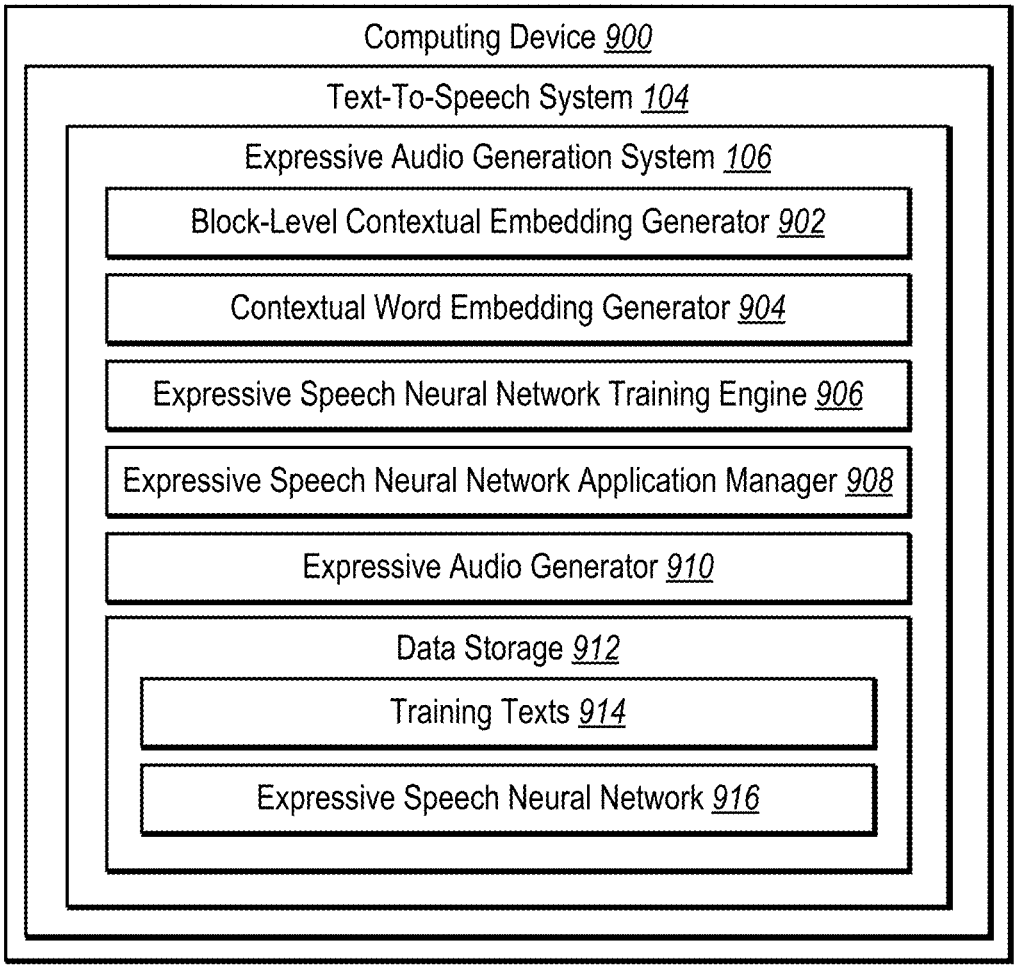
FIG. 9 illustrates an example schematic diagram of an expressive audio generation system in accordance with one or more embodiments.

Turning now to FIG. 9, additional detail will be provided regarding various components and capabilities of the expressive audio generation system 106. In particular, FIG. 9 illustrates the expressive audio generation system 106 implemented by the computing device 900 (e.g., the server(s) 102 and/or one of the client devices 110*a*-110*n* discussed above with reference to FIG. 1). Additionally, the expressive audio generation system 106 is also part of the text-to-speech system 104. As shown, the expressive audio generation system 106 can include, but is not limited to, a block-level contextual embedding generator 902, a contextual word embedding generator 904, an expressive speech neural network training engine 906, an expressive speech neural network application manager 908, an expressive audio generator 910, and data storage 912 (which includes training texts 914 and an expressive speech neural network 916).

As just mentioned, and as illustrated in FIG. 9, the expressive audio generation system 106 includes the block-level contextual embedding generator 902. In particular, the block-level contextual embedding generator 902 can generate block-level contextual embeddings for blocks of text that include input text. For example, where a paragraph includes an input text, the block-level contextual embedding generator 902 can generate a paragraph-level contextual embedding. But the block-level contextual embedding generator 902 can generate block-level contextual embeddings for a variety of blocks of text that include input texts, including pages, entire documents, etc.

Additionally, as shown in FIG. 9, the expressive audio generation system 106 includes the contextual word embedding generator 904. In particular, the contextual word embedding generator 904 can generate contextual word embeddings corresponding to a plurality of words of an input text. In one or more embodiments, the contextual word embedding generator 904 generates the contextual word embeddings using a block-level textual embedding that corresponds to a block of text that includes the input text and was generated by the block-level contextual embedding generator 902.

Further, as shown in FIG. 9, the expressive audio generation system 106 includes the expressive speech neural network training engine 906. In particular, the expressive speech neural network training engine 906 can train an expressive speech neural network to generate context-based speech maps for input texts. Indeed, in one or more embodiments, the expressive speech neural network training engine 906 trains an expressive speech neural network to generate a context-based speech map based on a plurality of words and a plurality of associated characters of an input text. In some embodiments, the expressive speech neural network training engine 906 trains the expressive speech neural network to generate the context-based speech map further based on speaker-based input.

As further shown in FIG. 9, the expressive audio generation system 106 includes the expressive speech neural network application manager 908. In particular, the expressive speech neural network application manager 908 can utilize an expressive speech neural network trained by the expressive speech neural network training engine 906. Indeed, the expressive speech neural network application manager 908 can utilize a trained expressive speech neural network to generate context-based speech maps for input texts. In one or more embodiments, the expressive speech neural network application manager 908 utilizes a trained expressive speech neural network to generate a context-based speech map based on a plurality of words and a plurality of associated characters of an input text. In some embodiments, the expressive speech neural network application manager 908 utilizes the trained expressive speech neural network to generate the context-based speech map further based on speaker-based input.

As shown in FIG. 9, the expressive audio generation system 106 also includes the expressive audio generator 910. In particular, the expressive audio generator 910 can generate expressive audio for an input text. For example, the expressive audio generator 910 can generate expressive audio based on a context-based speech map generated by the expressive speech neural network application manager 908 for an input text.

As further shown in FIG. 9, the expressive audio generation system 106 includes data storage 912. In particular, data storage includes training texts 914 and the expressive speech neural network 916. Training texts 914 can store the training texts used by the expressive speech neural network training engine 906 to train an expressive speech neural network. In some embodiments, training texts 914 further includes the ground truths used to train the expressive speech neural network. The expressive speech neural network 916 can store the expressive speech neural network trained by the expressive speech neural network training engine 906 and utilized by the expressive speech neural network application manager 908 to generate context-based speech maps for input texts. The data storage 912 can also include a variety of additional information, such as input texts, expressive audio, or speaker-based input.

Each of the components 902-916 of the expressive audio generation system 106 can include software, hardware, or both. For example, the components 902-916 can include one or more instructions stored on a computer-readable storage medium and executable by processors of one or more computing devices, such as a client device or server device. When executed by the one or more processors, the computer-executable instructions of the expressive audio generation system 106 can cause the computing device(s) to perform the methods described herein. Alternatively, the components 902-916 can include hardware, such as a special-purpose processing device to perform a certain function or group of functions. Alternatively, the components 902-916 of the expressive audio generation system 106 can include a combination of computer-executable instructions and hardware.

Furthermore, the components 902-916 of the expressive audio generation system 106 may, for example, be implemented as one or more operating systems, as one or more stand-alone applications, as one or more modules of an application, as one or more plug-ins, as one or more library functions or functions that may be called by other applications, and/or as a cloud-computing model. Thus, the components 902-916 of the expressive audio generation system 106 may be implemented as a stand-alone application, such as a desktop or mobile application. Furthermore, the components 902-916 of the expressive audio generation system 106 may be implemented as one or more web-based applications hosted on a remote server. Alternatively, or additionally, the components 902-916 of the expressive audio generation system 106 may be implemented in a suite of mobile device applications or "apps." For example, in one or more embodiments, the expressive audio generation system 106 can comprise or operate in connection with digital software applications such as ADOBE® AUDITION®, ADOBE® CAPTIVATE®, or ADOBE® SENSEI. "ADOBE," "AUDITION," "CAPTIVATE," and "SENSEI" are either registered trademarks or trademarks of Adobe Inc. in the United States and/or other countries.

Figure 10:
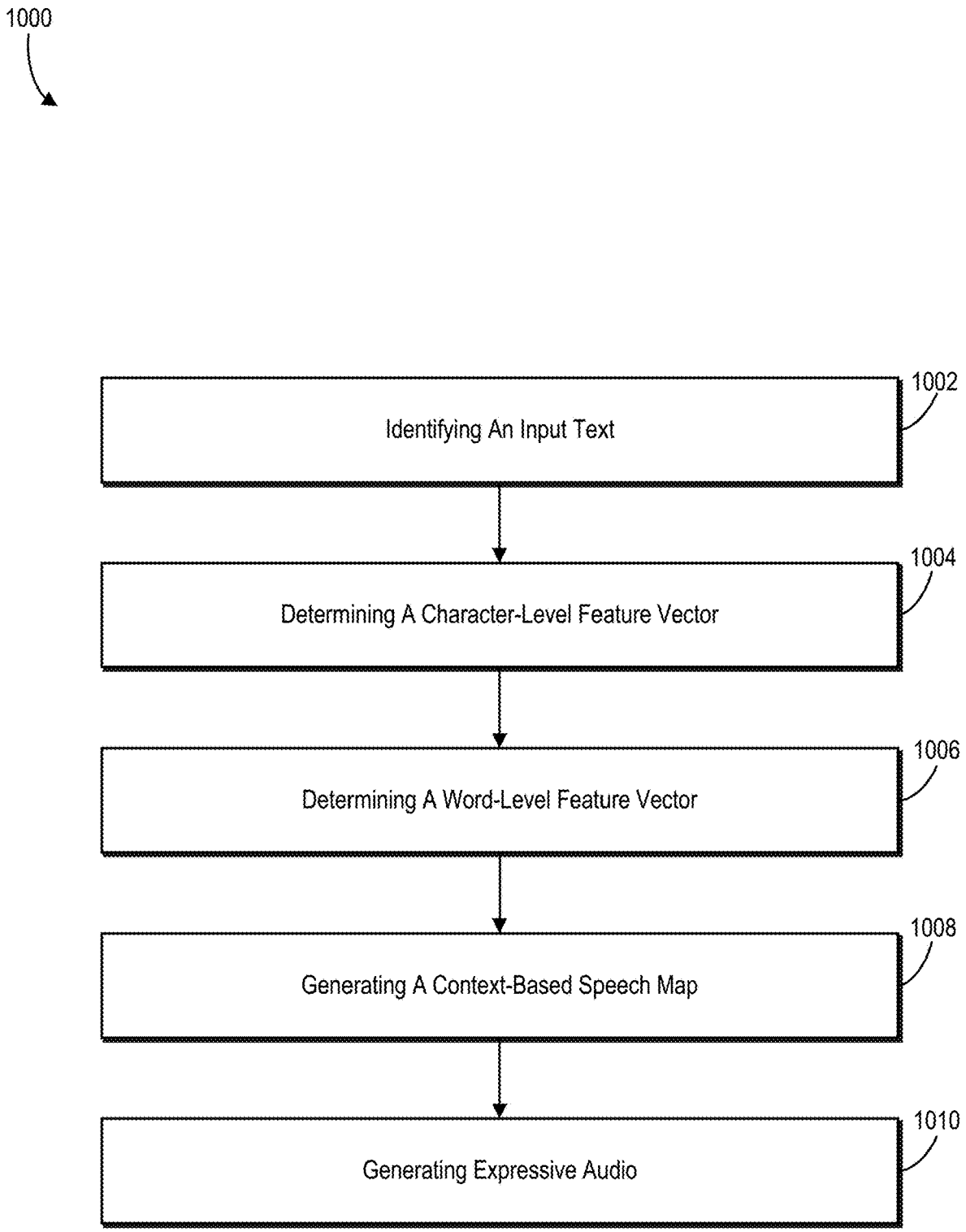
FIG. 10 illustrates a flowchart of a series of acts for generating expressive audio for an input text in accordance with one or more embodiments.

FIGS. 1-9, the corresponding text and the examples provide a number of different methods, systems, devices, and non-transitory computer-readable media of the expressive audio generation system 106. In addition to the foregoing, one or more embodiments can also be described in terms of flowcharts comprising acts for accomplishing particular results, as shown in FIG. 10. FIG. 10 may be performed with more or fewer acts. Further, the acts may be performed in different orders. Additionally, the acts described herein may be repeated or performed in parallel with one another or in parallel with different instances of the same or similar acts.

FIG. 10 illustrates a flowchart of a series of acts 1000 for generating expressive audio for an input text in accordance with one or more embodiments. While FIG. 10 illustrates acts according to one embodiment, alternative embodiments may omit, add to, reorder, and/or modify any of the acts shown in FIG. 10. The acts of FIG. 10 can be performed as part of a method. For example, in some embodiments, the acts of FIG. 10 can be performed as part of a computer-implemented method for expressive text-to-speech utilizing word-level analysis. Alternatively, a non-transitory computer-readable medium can store instructions thereon that, when executed by at least one processor, cause a computing device to perform the acts of FIG. 10. In some embodiments, a system can perform the acts of FIG. 10. For example, in one or more embodiments, a system includes one or more memory devices comprising an input text having a plurality of words with a plurality of characters and an expressive speech neural network having a character-level channel, a word-level channel, and a decoder. The system can further include one or more server devices configured to cause the system to perform the acts of FIG. 10.

The series of acts 1000 includes an act 1002 of identifying an input text. For example, the act 1002 can involve identifying an input text comprising a plurality of words. As mentioned previously, the expressive audio generation system 106 can identify input text based on user input (e.g., from a client device) or from a repository of input texts.

The series of acts 1000 also includes an act 1004 of determining a character-level feature vector. For example, the act 1004 can involve determining, utilizing a character-level channel of an expressive speech neural network, a character-level feature vector based on a plurality of characters associated with the plurality of words. In one or more embodiments, determining the character-level feature vector based on the plurality of characters associated with the plurality of words includes: generating character embeddings for the plurality of characters; and utilizing a location-sensitive attention mechanism of the character-level channel to generate the character-level feature vector based on the character embeddings for the plurality of characters.

Indeed, in some embodiments, determining the character-level feature vector based on the plurality of characters comprises: generating, utilizing a character-level encoder of the character-level channel, character encodings based on character embeddings corresponding to the plurality of characters; and utilizing a location-sensitive attention mechanism of the character-level channel to generate the character-level feature vector based on the character encodings and attention weights from previous time steps.

Further, the series of acts 1000 includes an act 1006 of determining a word-level feature vector. For example, the act 1006 can involve determining, utilizing a word-level channel of the expressive speech neural network, a word-level feature vector based on contextual word embeddings corresponding to the plurality of words. In one or more embodiments, the contextual word embeddings comprise BERT embeddings of the plurality of words of the input text.

In one or more embodiments, the expressive audio generation system 106 generates the contextual word embeddings. In some embodiments, the expressive audio generation system 106 generates the contextual word embeddings based using a larger block of text associated with the input text. For example, the expressive audio generation system 106 can identify the input text comprising the plurality of words by identifying a block of text comprising the input text; generate a block-level contextual embedding from the block of text; and generate the contextual word embeddings corresponding to the plurality of words from the block-level contextual embedding. As an example, in one or more embodiments, the expressive audio generation system 106 determines the contextual word embeddings reflecting the plurality of words from the input text by: determining a paragraph-level contextual embedding from a paragraph of text that comprises the input text; and generating the contextual word embeddings reflecting the plurality of words from the input text based on the paragraph-level contextual embedding.

In one or more embodiments, determining the word-level feature vector based on the contextual word embeddings includes utilizing an attention mechanism of the word-level channel to generate weighted contextual word-level style tokens from the contextual word embeddings, wherein the weighted contextual word-level style tokens correspond to one or more style features associated with the input text; and generating the word-level feature vector based on the weighted contextual word-level style tokens.

In some embodiments, utilizing the attention mechanism of the word-level channel to generate the weighted contextual word-level style tokens from the contextual word embeddings comprises utilizing a multi-head attention mechanism to generate the weighted contextual word-level style tokens from the contextual word embeddings. Further, in some embodiments, utilizing the attention mechanism of the word-level channel to generate the weighted contextual word-level style tokens that correspond to the one or more style features associated with the input text comprises generating a weighted contextual word-level style token corresponding to at least one of: a pitch of speech corresponding to the input text; an emotion of the speech corresponding to the input text; or a modulation of the speech corresponding to the input text.

Additionally, the series of acts 1000 includes an act 1008 of generating a context-based speech map. For example, the act 1008 can involve generating, utilizing a decoder of the expressive speech neural network, a context-based speech map based on the character-level feature vector and the word-level feature vector.

In one or more embodiments, generating, utilizing the decoder of the expressive speech neural network, the context-based speech map based on the character-level feature vector and the word-level feature vector includes: generating, utilizing the decoder of the expressive speech neural network, a first portion of the context-based speech map based on the character-level feature vector and the word-level feature vector at a first time step; and utilizing the decoder of the expressive speech neural network to generate a second portion of the context-based speech map at a second time step based on the character-level feature vector, the word-level feature vector, and the first portion of the context-based speech map.

In one or more embodiments, the context-based speech map comprises a Mel spectrogram. Accordingly, in one or more embodiments, generating the context-based speech map includes generating, utilizing the decoder, a first Mel frame based on the character-level feature vector and the word-level feature vector at a first time step; utilizing the decoder to generate a second Mel frame at a second time step based on the character-level feature vector, the word-level feature vector, and the first Mel frame; and generating a Mel spectrogram based on the first Mel frame and the second Mel frame.

In some embodiments, the expressive audio generation system 106 concatenates the character-level feature vector and the word-level feature vector; and generates the context-based speech map based on the character-level feature vector and the word-level feature vector by generating the context-based speech map based on the concatenation of the character-level feature vector and the word-level feature vector.

The series of acts 1000 further includes an act 1010 of generating expressive audio. For example, the act 1010 can include utilizing the context-based speech map to generate expressive audio for the input text.

To provide an illustration, in one or more embodiments, the expressive audio generation system 106 determines, utilizing the character-level channel, a character-level feature vector from character embeddings of the plurality of characters. Additionally, the expressive audio generation system 106 utilizes the word-level channel of the expressive speech neural network to: determine contextual word embeddings reflecting the plurality of words from the input text; generate, utilizing an attention mechanism of the word-level channel, contextual word-level style tokens from the contextual word embeddings, the contextual word-level style tokens corresponding to different style features associated with the input text; and generate a word-level feature vector from the contextual word-level style tokens. The expressive audio generation system 106 further combines the character-level feature vector and the word-level feature vector utilizing the decoder to generate expressive audio for the input text. The expressive audio generation system 106 can combine the character-level feature vector and the word-level feature vector utilizing the decoder to generate the expressive audio for the input text by: combining the character-level feature vector and the word-level feature vector utilizing the decoder to generate a context-based speech map; and generating the expressive audio for the input text based on the context-based speech map. Further, in some embodiments, the expressive audio generation system 106 generates the contextual word-level style tokens from the contextual word embeddings by generating weighted contextual word-level style tokens; and generates the word-level feature vector from the contextual word-level style tokens by generating the word-level feature vector based on a weighted sum of the weighted contextual word-level style tokens.

In one or more embodiments, the series of acts 1000 further includes acts for generating the expressive audio for the input text based on speaker-based input for the input text. For example, in one or more embodiments, the acts include determining, utilizing a speaker identification channel of the expressive speech neural network, a speaker identity feature vector from speaker-based input. For example, the acts can include receiving user input corresponding to a speaker identity for the input text; and determining, utilizing a speaker identification channel of the expressive speech neural network, a speaker identity feature vector based on the speaker identity. The acts can further include generating, utilizing the decoder of the expressive speech neural network, the context-based speech map based on the speaker identity feature vector, the character-level feature vector, and the word-level feature vector. The expressive audio generation system 106 can generate the expressive audio for the input text using on the context-based speech map.

To provide an illustration, the acts can include receiving user input corresponding to a speaker identity for the input text; generating a speaker identity feature vector based on the speaker identity utilizing a speaker identification channel of the expressive speech neural network; and generating the expressive audio for the input text further based on the speaker identity feature vector. Indeed, in such an embodiment, combining the character-level feature vector and the word-level feature vector utilizing the decoder to generate the expressive audio for the input text includes concatenating the character-level feature vector, the word-level feature vector, and the speaker identity feature vector to generate the expressive audio for the input text.

Embodiments of the present disclosure may comprise or utilize a special purpose or general-purpose computer including computer hardware, such as, for example, one or more processors and system memory, as discussed in greater detail below. Embodiments within the scope of the present disclosure also include physical and other computer-readable media for carrying or storing computer-executable instructions and/or data structures. In particular, one or more of the processes described herein may be implemented at least in part as instructions embodied in a non-transitory computer-readable medium and executable by one or more computing devices (e.g., any of the media content access devices described herein). In general, a processor (e.g., a microprocessor) receives instructions, from a non-transitory computer-readable medium, (e.g., a memory), and executes those instructions, thereby performing one or more processes, including one or more of the processes described herein.

Computer-readable media can be any available media that can be accessed by a general purpose or special purpose computer system. Computer-readable media that store computer-executable instructions are non-transitory computer-readable storage media (devices). Computer-readable media that carry computer-executable instructions are transmission media. Thus, by way of example, and not limitation, embodiments of the disclosure can comprise at least two distinctly different kinds of computer-readable media: non-transitory computer-readable storage media (devices) and transmission media.

Non-transitory computer-readable storage media (devices) includes RAM, ROM, EEPROM, CD-ROM, solid state drives ("SSDs") (e.g., based on RAM), Flash memory, phase-change memory ("PCM"), other types of memory, other optical disk storage, magnetic disk storage or other magnetic storage devices, or any other medium which can be used to store desired program code means in the form of computer-executable instructions or data structures and which can be accessed by a general purpose or special purpose computer.

A "network" is defined as one or more data links that enable the transport of electronic data between computer systems and/or modules and/or other electronic devices. When information is transferred or provided over a network or another communications connection (either hardwired, wireless, or a combination of hardwired or wireless) to a computer, the computer properly views the connection as a transmission medium. Transmissions media can include a network and/or data links which can be used to carry desired program code means in the form of computer-executable instructions or data structures and which can be accessed by a general purpose or special purpose computer. Combinations of the above should also be included within the scope of computer-readable media.

Further, upon reaching various computer system components, program code means in the form of computer-executable instructions or data structures can be transferred automatically from transmission media to non-transitory computer-readable storage media (devices) (or vice versa). For example, computer-executable instructions or data structures received over a network or data link can be buffered in RAM within a network interface module (e.g., a "NIC"), and then eventually transferred to computer system RAM and/or to less volatile computer storage media (devices) at a computer system. Thus, it should be understood that non-transitory computer-readable storage media (devices) can be included in computer system components that also (or even primarily) utilize transmission media.

Computer-executable instructions comprise, for example, instructions and data which, when executed by a processor, cause a general-purpose computer, special purpose computer, or special purpose processing device to perform a certain function or group of functions. In some embodiments, computer-executable instructions are executed on a general-purpose computer to turn the general-purpose computer into a special purpose computer implementing elements of the disclosure. The computer executable instructions may be, for example, binaries, intermediate format instructions such as assembly language, or even source code. Although the subject matter has been described in language specific to structural features and/or methodological acts, it is to be understood that the subject matter defined in the appended claims is not necessarily limited to the described features or acts described above. Rather, the described features and acts are disclosed as example forms of implementing the claims.

Those skilled in the art will appreciate that the disclosure may be practiced in network computing environments with many types of computer system configurations, including, personal computers, desktop computers, laptop computers, message processors, hand-held devices, multiprocessor systems, microprocessor-based or programmable consumer electronics, network PCs, minicomputers, mainframe computers, mobile telephones, PDAs, tablets, pagers, routers, switches, and the like. The disclosure may also be practiced in distributed system environments where local and remote computer systems, which are linked (either by hardwired data links, wireless data links, or by a combination of hardwired and wireless data links) through a network, both perform tasks. In a distributed system environment, program modules may be located in both local and remote memory storage devices.

Embodiments of the present disclosure can also be implemented in cloud computing environments. In this description, "cloud computing" is defined as a model for enabling on-demand network access to a shared pool of configurable computing resources. For example, cloud computing can be employed in the marketplace to offer ubiquitous and convenient on-demand access to the shared pool of configurable computing resources. The shared pool of configurable computing resources can be rapidly provisioned via virtualization and released with low management effort or service provider interaction, and then scaled accordingly.

A cloud-computing model can be composed of various characteristics such as, for example, on-demand self-service, broad network access, resource pooling, rapid elasticity, measured service, and so forth. A cloud-computing model can also expose various service models, such as, for example, Software as a Service ("SaaS"), Platform as a Service ("PaaS"), and Infrastructure as a Service ("IaaS"). A cloud-computing model can also be deployed using different deployment models such as private cloud, community cloud, public cloud, hybrid cloud, and so forth. In this description and in the claims, a "cloud-computing environment" is an environment in which cloud computing is employed.

Figure 11:
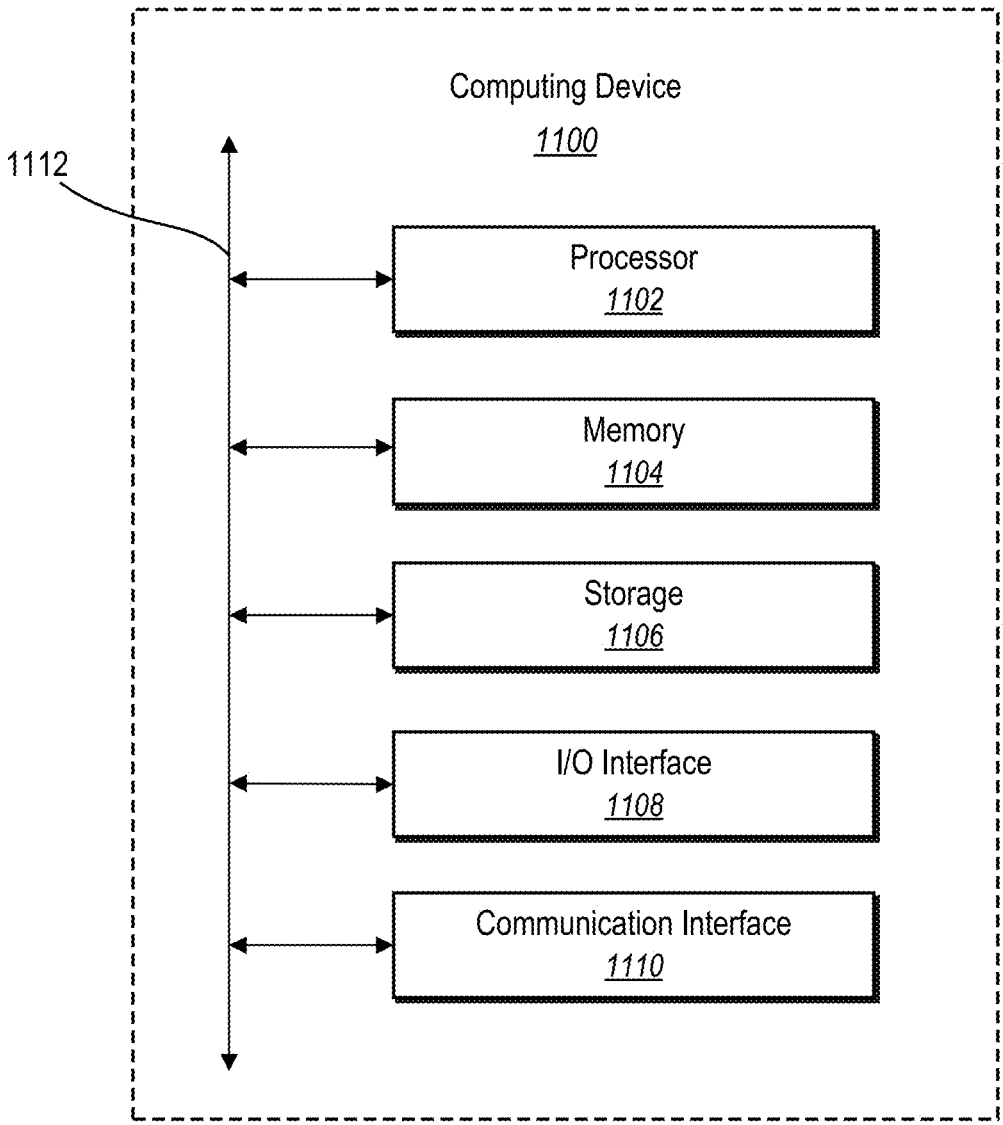
FIG. 11 illustrates a block diagram of an exemplary computing device in accordance with one or more embodiments.

FIG. 11 illustrates a block diagram of an example computing device 1100 that may be configured to perform one or more of the processes described above. One will appreciate that one or more computing devices, such as the computing device 1100 may represent the computing devices described above (e.g., the server(s) 102 and/or the client devices 110*a*-110*n*). In one or more embodiments, the computing device 1100 may be a mobile device (e.g., a mobile telephone, a smartphone, a PDA, a tablet, a laptop, a camera, a tracker, a watch, a wearable device). In some embodiments, the computing device 1100 may be a non-mobile device (e.g., a desktop computer or another type of client device). Further, the computing device 1100 may be a server device that includes cloud-based processing and storage capabilities.

As shown in FIG. 11, the computing device 1100 can include one or more processor(s) 1102, memory 1104, a storage device 1106, input/output interfaces 1108 (or "I/O interfaces 1108"), and a communication interface 1110, which may be communicatively coupled by way of a communication infrastructure (e.g., bus 1112). While the computing device 1100 is shown in FIG. 11, the components illustrated in FIG. 11 are not intended to be limiting. Additional or alternative components may be used in other embodiments. Furthermore, in certain embodiments, the computing device 1100 includes fewer components than those shown in FIG. 11. Components of the computing device 1100 shown in FIG. 11 will now be described in additional detail.

In particular embodiments, the processor(s) 1102 includes hardware for executing instructions, such as those making up a computer program. As an example, and not by way of limitation, to execute instructions, the processor(s) 1102 may retrieve (or fetch) the instructions from an internal register, an internal cache, memory 1104, or a storage device 1106 and decode and execute them.

The computing device 1100 includes memory 1104, which is coupled to the processor(s) 1102. The memory 1104 may be used for storing data, metadata, and programs for execution by the processor(s). The memory 1104 may include one or more of volatile and non-volatile memories, such as Random-Access Memory ("RAM"), Read-Only Memory ("ROM"), a solid-state disk ("SSD"), Flash, Phase Change Memory ("PCM"), or other types of data storage. The memory 1104 may be internal or distributed memory.

The computing device 1100 includes a storage device 1106 including storage for storing data or instructions. As an example, and not by way of limitation, the storage device 1106 can include a non-transitory storage medium described above. The storage device 1106 may include a hard disk drive (HDD), flash memory, a Universal Serial Bus (USB) drive or a combination these or other storage devices.

As shown, the computing device 1100 includes one or more I/O interfaces 1108, which are provided to allow a user to provide input to (such as user strokes), receive output from, and otherwise transfer data to and from the computing device 1100. These I/O interfaces 1108 may include a mouse, keypad or a keyboard, a touch screen, camera, optical scanner, network interface, modem, other known I/O devices or a combination of such I/O interfaces 1108. The touch screen may be activated with a stylus or a finger.

The I/O interfaces 1108 may include one or more devices for presenting output to a user, including, but not limited to, a graphics engine, a display (e.g., a display screen), one or more output drivers (e.g., display drivers), one or more audio speakers, and one or more audio drivers. In certain embodiments, I/O interfaces 1108 are configured to provide graphical data to a display for presentation to a user. The graphical data may be representative of one or more graphical user interfaces and/or any other graphical content as may serve a particular implementation.

The computing device 1100 can further include a communication interface 1110. The communication interface 1110 can include hardware, software, or both. The communication interface 1110 provides one or more interfaces for communication (such as, for example, packet-based communication) between the computing device and one or more other computing devices or one or more networks. As an example, and not by way of limitation, communication interface 1110 may include a network interface controller (NIC) or network adapter for communicating with an Ethernet or other wire-based network or a wireless NIC (WNIC) or wireless adapter for communicating with a wireless network, such as a WI-FI. The computing device 1100 can further include a bus 1112. The bus 1112 can include hardware, software, or both that connects components of computing device 1100 to each other.

In the foregoing specification, the invention has been described with reference to specific example embodiments thereof. Various embodiments and aspects of the invention(s) are described with reference to details discussed herein, and the accompanying drawings illustrate the various embodiments. The description above and drawings are illustrative of the invention and are not to be construed as limiting the invention. Numerous specific details are described to provide a thorough understanding of various embodiments of the present invention.

The present invention may be embodied in other specific forms without departing from its spirit or essential characteristics. The described embodiments are to be considered in all respects only as illustrative and not restrictive. For example, the methods described herein may be performed with less or more steps/acts or the steps/acts may be performed in differing orders. Additionally, the steps/acts described herein may be repeated or performed in parallel to one another or in parallel to different instances of the same or similar steps/acts. The scope of the invention is, therefore, indicated by the appended claims rather than by the foregoing description. All changes that come within the meaning and range of equivalency of the claims are to be embraced within their scope.

What is claimed is:

1. A non-transitory computer-readable medium storing instructions thereon that, when executed by at least one processor, cause a computing device to:

identify an input text comprising digital text having a plurality of characters and a plurality of words containing the plurality of characters;

generate a context-based speech map from the input text utilizing an expressive speech neural network having a multi-channel neural network architecture that encodes the plurality of characters and encodes the plurality of words containing the plurality of characters by:

determining, utilizing a character-level channel of the expressive speech neural network, a character-level feature vector based on a plurality of characters associated with the plurality of words;

determining, utilizing a word-level channel of the expressive speech neural network, a word-level feature vector based on contextual word embeddings corresponding to the plurality of words; and generating, utilizing a decoder of the expressive speech neural network, a context-based speech map based on the character-level feature vector and the word-level feature vector; and utilize the context-based speech map to generate expressive audio for the input text.

2. The non-transitory computer-readable medium of claim 1, further comprising instructions that, when executed by the at least one processor, cause the computing device to:

determine, utilizing a speaker identification channel of the expressive speech neural network, a speaker identity feature vector from speaker-based input; and generate, utilizing the decoder of the expressive speech neural network, the context-based speech map based on the speaker identity feature vector, the character-level feature vector, and the word-level feature vector.

3. The non-transitory computer-readable medium of claim 1, further comprising instructions that, when executed by the at least one processor, cause the computing device to determine the word-level feature vector based on the contextual word embeddings by:

utilizing an attention mechanism of the word-level channel to generate weighted contextual word-level style tokens from the contextual word embeddings, wherein the weighted contextual word-level style tokens correspond to one or more style features associated with the input text; and generating the word-level feature vector based on the weighted contextual word-level style tokens.

4. The non-transitory computer-readable medium of claim 3, wherein utilizing the attention mechanism of the word-level channel to generate the weighted contextual word-level style tokens from the contextual word embeddings comprises utilizing a multi-head attention mechanism to generate the weighted contextual word-level style tokens from the contextual word embeddings.

5. The non-transitory computer-readable medium of claim 3, wherein utilizing the attention mechanism of the word-level channel to generate the weighted contextual word-level style tokens that correspond to the one or more style features associated with the input text comprises generating a weighted contextual word-level style token corresponding to at least one of:

a pitch of speech corresponding to the input text;

an emotion of the speech corresponding to the input text; or a modulation of the speech corresponding to the input text.

6. The non-transitory computer-readable medium of claim 1, further comprising instructions that, when executed by the at least one processor, cause the computing device to:

identify the input text comprising the plurality of words by identifying a block of text comprising the input text;

generate a block-level contextual embedding from the block of text; and generate the contextual word embeddings corresponding to the plurality of words from the block-level contextual embedding.

7. The non-transitory computer-readable medium of claim 1, further comprising instructions that, when executed by the at least one processor, cause the computing device to generate, utilizing the decoder of the expressive speech neural network, the context-based speech map based on the character-level feature vector and the word-level feature vector by:

generate, utilizing the decoder of the expressive speech neural network, a first portion of the context-based speech map based on the character-level feature vector and the word-level feature vector at a first time step; and utilize the decoder of the expressive speech neural network to generate a second portion of the context-based speech map at a second time step based on the character-level feature vector, the word-level feature vector, and the first portion of the context-based speech map.

8. The non-transitory computer-readable medium of claim 1, further comprising instructions that, when executed by the at least one processor, cause the computing device to:

concatenate the character-level feature vector and the word-level feature vector; and generate the context-based speech map based on the character-level feature vector and the word-level feature vector by generating the context-based speech map based on the concatenation of the character-level feature vector and the word-level feature vector.

9. The non-transitory computer-readable medium of claim 1, further comprising instructions that, when executed by the at least one processor, cause the computing device to determine the character-level feature vector based on the plurality of characters associated with the plurality of words by:

generating character embeddings for the plurality of characters; and utilizing a location-sensitive attention mechanism of the character-level channel to generate the character-level feature vector based on the character embeddings for the plurality of characters.

10. A system comprising:

one or more memory devices comprising:

an input text comprising digital text having a plurality of characters and a plurality of words containing the plurality of characters; and an expressive speech neural network having a multi-channel neural network architecture that includes a character-level channel, a word-level channel, and a decoder; and one or more server devices configured to cause the system to:

determine, utilizing the character-level channel of the expressive speech neural network, a character-level feature vector from character embeddings of the plurality of characters;

utilize the word-level channel of the expressive speech neural network to:

determine contextual word embeddings reflecting the plurality of words from the input text;

generate, utilizing an attention mechanism of the word-level channel, contextual word-level style tokens from the contextual word embeddings, the contextual word-level style tokens corresponding to different style features associated with the input text; and generate a word-level feature vector from the contextual word-level style tokens; and combine the character-level feature vector and the word-level feature vector utilizing the decoder to generate expressive audio for the input text.

11. The system of claim 10, wherein the one or more server devices are configured to cause the system to combine the character-level feature vector and the word-level feature vector utilizing the decoder to generate the expressive audio for the input text by:

combining the character-level feature vector and the word-level feature vector utilizing the decoder to generate a context-based speech map; and generating the expressive audio for the input text based on the context-based speech map.

12. The system of claim 11, wherein the one or more server devices are configured to cause the system to generate the context-based speech map by:

generating, utilizing the decoder, a first Mel frame based on the character-level feature vector and the word-level feature vector at a first time step;

utilizing the decoder to generate a second Mel frame at a second time step based on the character-level feature vector, the word-level feature vector, and the first Mel frame; and generating a Mel spectrogram based on the first Mel frame and the second Mel frame.

13. The system of claim 10, wherein the one or more server devices are further configured to cause the system to:

receive user input corresponding to a speaker identity for the input text; and determine, utilizing a speaker identification channel of the expressive speech neural network, a speaker identity feature vector based on the speaker identity.

14. The system of claim 13, wherein the one or more server devices are configured to cause the system to combine the character-level feature vector and the word-level feature vector utilizing the decoder to generate the expressive audio for the input text by concatenating the character-level feature vector, the word-level feature vector, and the speaker identity feature vector to generate the expressive audio for the input text.

15. The system of claim 10, wherein the one or more server devices are configured to cause the system to determine the contextual word embeddings reflecting the plurality of words from the input text by:

determining a paragraph-level contextual embedding from a paragraph of text that comprises the input text; and generating the contextual word embeddings reflecting the plurality of words from the input text based on the paragraph-level contextual embedding.

16. The system of claim 10, wherein the one or more server devices are configured to cause the system to:

generate the contextual word-level style tokens from the contextual word embeddings by generating weighted contextual word-level style tokens; and generate the word-level feature vector from the contextual word-level style tokens by generating the word-level feature vector based on a weighted sum of the weighted contextual word-level style tokens.

17. A computer-implemented method for expressive text-to-speech utilizing word-level analysis comprising:

identifying an input text comprising digital text having a plurality of characters and a plurality of words containing the plurality of characters;

determining, utilizing a character-level channel of an expressive speech neural network, a character-level feature vector based on the plurality of characters associated with the plurality of words;

performing a step for generating a context-based speech map from contextual word embeddings of the plurality of words of the input text and the character-level feature vector; and utilizing the context-based speech map to generate expressive audio for the input text.

18. The computer-implemented method of claim 17, wherein determining the character-level feature vector based on the plurality of characters comprises:

generating, utilizing a character-level encoder of the character-level channel, character encodings based on character embeddings corresponding to the plurality of characters; and utilizing a location-sensitive attention mechanism of the character-level channel to generate the character-level feature vector based on the character encodings and attention weights from previous time steps.

19. The computer-implemented method of claim 17, further comprising:

receiving user input corresponding to a speaker identity for the input text;

generating a speaker identity feature vector based on the speaker identity utilizing a speaker identification channel of the expressive speech neural network; and generating the expressive audio for the input text further based on the speaker identity feature vector.

20. The computer-implemented method of claim 17, wherein the context-based speech map comprises a Mel spectrogram and the contextual word embeddings comprise BERT (Bidirectional Encoder Representations from Transformers) embeddings of the plurality of words of the input text.

* * * * *